US009946181B2

(12) United States Patent
Hasegawa et al.

(10) Patent No.: US 9,946,181 B2
(45) Date of Patent: Apr. 17, 2018

(54) TONER

(71) Applicant: CANON KABUSHIKI KAISHA, Tokyo (JP)

(72) Inventors: Yusuke Hasegawa, Suntou-gun (JP); Tomohisa Sano, Mishima (JP); Yoshitaka Suzumura, Mishima (JP); Takuma Ikejiri, Suntou-gun (JP); Shohei Yamashita, Mishima (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/586,732

(22) Filed: May 4, 2017

(65) Prior Publication Data

US 2017/0336726 A1 Nov. 23, 2017

(30) Foreign Application Priority Data

May 20, 2016 (JP) ..... 2016-101238

(51) Int. Cl.
*G03G 9/08* (2006.01)
*G03G 9/087* (2006.01)
*G03G 9/09* (2006.01)

(52) U.S. Cl.
CPC ..... *G03G 9/08755* (2013.01); *G03G 9/0819* (2013.01); *G03G 9/08711* (2013.01); *G03G 9/0904* (2013.01); *G03G 9/0926* (2013.01)

(58) Field of Classification Search
CPC . G03G 9/08755; G03G 9/0926; G03G 9/0821
USPC ..... 430/109.4
See application file for complete search history.

(56) References Cited

U.S. PATENT DOCUMENTS

| | | | |
|---|---|---|---|
| 6,703,176 | B2 | 3/2004 | Naka et al. |
| 6,803,164 | B2 | 10/2004 | Mlzoo et al. |
| 6,953,646 | B2 | 10/2005 | Doujo et al. |
| 7,123,862 | B2 | 10/2006 | Hasegawa et al. |
| 7,160,660 | B2 | 1/2007 | Dojo et al. |
| 7,368,211 | B2 | 5/2008 | Hasegawa et al. |
| 7,470,494 | B2 | 12/2008 | Nishiyama et al. |
| 7,582,401 | B2 | 9/2009 | Ogawa et al. |
| 7,678,523 | B2 | 3/2010 | Hiroko et al. |
| 7,678,524 | B2 | 3/2010 | Hasegawa et al. |
| 7,704,659 | B2 | 4/2010 | Ogawa et al. |

(Continued)

FOREIGN PATENT DOCUMENTS

| | | | |
|---|---|---|---|
| JP | 4155108 | B2 | 9/2008 |
| JP | 4192717 | B2 | 12/2008 |

(Continued)

*Primary Examiner* — Mark A Chapman
(74) *Attorney, Agent, or Firm* — Fitzpatrick Cella Harper and Scinto

(57) ABSTRACT

A toner comprises toner particles, each of which contains a binder resin, a colorant, a wax and a crystalline polyester. The melting point P(t) of the crystalline polyester is at least 65.0° C. and not more than 80.0° C., and regarding a storage elastic modulus G' obtained in dynamic viscoelasticity measurement of the toner, where G' at 50° C. is denoted by G'(50), G' at 80° C. is denoted by G'(80), G' at 120° C. is denoted by G'(120), and G' at the melting point P(t) of the crystalline polyester is denoted by G'(t), the following formulas are satisfied: $4.2\times10^8$ Pa≤G'(50), $3.0\times10^2$≤G'(50)/G'(80), and G'(t)/G'(120)≤$7.0\times10^2$.

8 Claims, 6 Drawing Sheets

(56) References Cited

U.S. PATENT DOCUMENTS

| | | | |
|---|---|---|---|
| 7,811,734 | B2 | 10/2010 | Ogawa et al. |
| 7,923,190 | B2 | 4/2011 | Magome et al. |
| 7,935,467 | B2 | 5/2011 | Dojo et al. |
| 7,939,231 | B2 | 5/2011 | Ogawa et al. |
| 8,084,174 | B2 | 12/2011 | Hasegawa et al. |
| 8,124,306 | B2 | 2/2012 | Hirata et al. |
| 8,227,162 | B2 | 7/2012 | Sano et al. |
| 8,426,091 | B2 | 4/2013 | Magome et al. |
| 8,426,094 | B2 | 4/2013 | Magome et al. |
| 8,518,620 | B2 | 8/2013 | Dojo et al. |
| 8,614,044 | B2 | 12/2013 | Matsui et al. |
| 8,778,585 | B2 | 7/2014 | Matsui et al. |
| 8,841,054 | B2 | 9/2014 | Dojo et al. |
| 8,918,035 | B2 | 12/2014 | Hasegawa et al. |
| 9,029,055 | B2 | 5/2015 | Aoki et al. |
| 9,097,997 | B2 | 8/2015 | Nomura et al. |
| 9,152,065 | B2 | 10/2015 | Sano et al. |
| 9,158,216 | B2 | 10/2015 | Shimano et al. |
| 9,213,250 | B2 | 12/2015 | Nomura et al. |
| 9,213,251 | B2 | 12/2015 | Ohmori et al. |
| 9,217,943 | B2 | 12/2015 | Matsui et al. |
| 9,235,151 | B2 | 1/2016 | Tanaka et al. |
| 9,239,528 | B2 | 1/2016 | Hasegawa et al. |
| 9,244,371 | B2 | 1/2016 | Suzumura et al. |
| 9,377,708 | B2 | 6/2016 | Magome et al. |
| 9,454,096 | B2 | 9/2016 | Hasegawa et al. |
| 9,551,947 | B2 | 1/2017 | Hiroko et al. |
| 9,625,841 | B2 | 4/2017 | Hiroko et al. |
| 9,625,842 | B2 | 4/2017 | Uratani et al. |
| 9,658,548 | B2 | 5/2017 | Magome et al. |
| 2009/0197192 | A1 | 8/2009 | Hiroko et al. |
| 2013/0171557 | A1 | 7/2013 | Watanabe et al. |
| 2014/0302437 | A1 | 10/2014 | Shimano et al. |
| 2015/0227067 | A1 | 8/2015 | Hasegawa et al. |
| 2015/0227068 | A1 | 8/2015 | Sano et al. |
| 2016/0266509 | A1 | 9/2016 | Sano et al. |
| 2016/0378003 | A1 | 12/2016 | Arimura et al. |
| 2017/0160656 | A1 | 6/2017 | Suzumura et al. |
| 2017/0160657 | A1 | 6/2017 | Suzumura et al. |
| 2017/0160660 | A1 | 6/2017 | Hasegawa et al. |
| 2017/0160661 | A1 | 6/2017 | Suzumura et al. |
| 2017/0160662 | A1 | 6/2017 | Nagashima et al. |
| 2017/0160663 | A1 | 6/2017 | Arimura et al. |

FOREIGN PATENT DOCUMENTS

| | | | |
|---|---|---|---|
| JP | 2010145550 | A | 7/2010 |
| JP | 2013137420 | A | 7/2013 |
| JP | 2014211632 | A | 11/2014 |
| JP | 5672095 | B2 | 2/2015 |

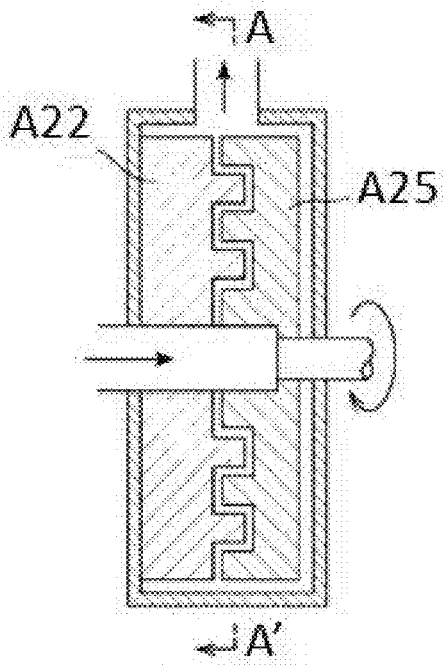
Fig. 6A
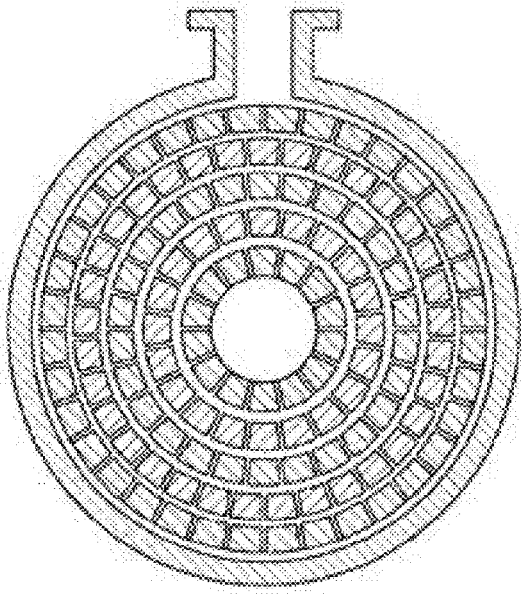
Fig. 6B
Fig. 6C
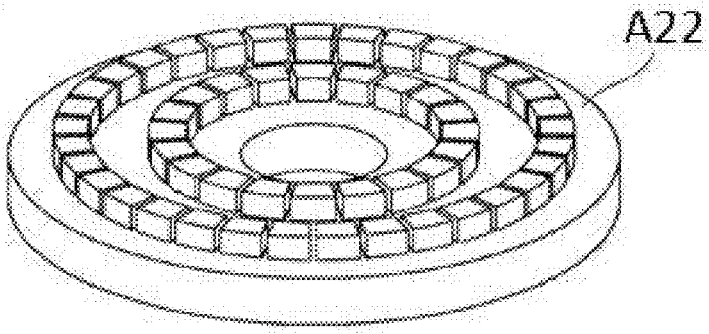
Fig. 6D
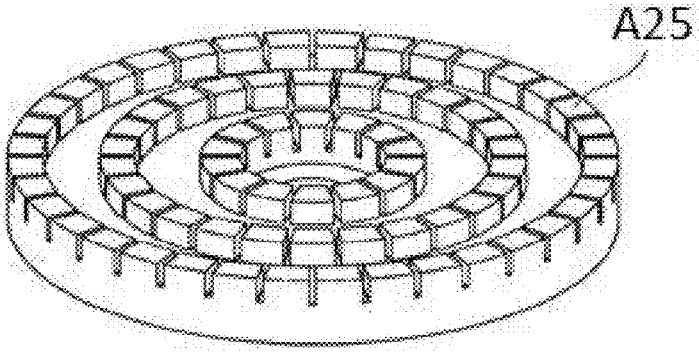

TONER

BACKGROUND OF THE INVENTION

Field of the Invention

The present invention relates to a toner suitable for a recording method used in an electrophotographic method or the like.

Description of the Related Art

In recent years, the diversification of intended use and usage environment of image forming apparatuses such as copiers and printers created a demand for a higher speed, higher image quality, and higher stability.

An electrophotographic method includes a charging step of charging an electrostatic latent image bearing member (also referred to hereinbelow as a photosensitive member) with a charging means, an exposure step of exposing the charged electrostatic latent image bearing member to form an electrostatic latent image, and a development step of developing the electrostatic latent image with a toner to form a toner image.

An image is then outputted through a transfer step of transferring the toner image to a recording material with or without an intermediary transfer member interposed therebetween, and a fixing step of heating, pressurizing and fixing by causing the recording material bearing the toner image to pass through a nip portion formed by a pressurizing member and a rotatable image heating member.

Optimization of each step is important to meet recent demands for higher quality and energy saving. Among them, with respect to image quality, a development step of developing an electrostatic latent image with a toner to form a toner image becomes particularly important, and in order to save energy, it is important to ensure sufficient fixing at a low temperature.

A method for using for a toner a crystalline polyester which becomes rapidly compatible with the binder resin of the toner and promotes melt deformation of the toner and also controlling viscoelastic characteristics of the toner has been extensively studied in recent years as a means for improving low-temperature fixing performance (see Japanese Patent Application Publication No. 2013-137420 and Japanese Patent Nos. 4192717, 4155108, and 5672095).

A crystalline polyester highly effective in improving the low-temperature fixing performance has a property of being easily compatible with the binder resin in the vicinity of the melting point thereof, and the toner including such crystalline polyester is likely to melt and deform rapidly at the time of fixing. Therefore, by using the crystalline polyester, the low-temperature fixing performance of the toner is improved. Where a wax is used in combination therewith, it is possible to impart release performance to the toner with respect to a fixing device, and further improvement of low-temperature fixing performance can be expected.

However, since the crystalline polyester has the property of being easily compatible with the binder resin, the crystalline polyester tends to be present on the surface of the toner, and the charge stability of the toner is likely to be lowered. In particular, when the toner is stored under a high-temperature severe environment, for example, when the toner is transported, the crystalline polyester compatible with the binder resin easily seeps out to the toner surface.

As a result, the surface composition of the toner is likely to change, for example, the performance such as resistance to fogging is greatly degraded. In particular, when a storage elastic modulus at a temperature from room temperature to the vicinity of 50° C. is relatively low, an external additive such as silica fine particles on the surface of the toner is buried due to the weight of the toner. As a consequence, flowability tends to decrease, charging performance of the toner becomes uneven, and occurrence of fogging is more likely to be manifested.

To resolve this problem, studies have been conducted to reduce the degree of compatibility of the crystalline polyester with the binder resin. Reducing the degree of compatibility means achieving a state in which the degree of crystallinity of the crystalline polyester is high. In particular, a method for producing a toner which is aimed at the crystallization of a crystalline polyester has already been studied. In Japanese Patent Application Publication No. 2010-145550, the degree of crystallinity of the crystalline polyester is improved by controlling the cooling rate. Further, in Japanese Patent Application Publication No. 2014-211632, an annealing step is provided during cooling to increase the degree of crystallinity.

SUMMARY OF THE INVENTION

However, with respect to the abovementioned patent documents, there is room for improvement not only with respect to the low-temperature fixing performance and the below-described density unevenness, but also in terms of preventing the decrease in charge stability caused by the presence of the crystalline polyester on the surface of toner particle and ensuring resistance to severe environment, for example, when various mass flows are assumed. Further, where attention is focused on the fixing step from the viewpoint of further improving image quality, a problem of occurrence of a trailing end offset in images with a high print percentage under high-temperature and high-humidity environment is manifested as the intended use and usage environment are diversified.

In general, in the fixing step, when paper on which unfixed toner image has been formed passes through the fixing device (in particular, a portion through which the paper passes is referred to hereinbelow as a fixing nip), heat and pressure are applied, whereby the toner is fixed to the paper.

The offset is more likely to occur in images with a high print percentage than in images with a low print percentage apparently because of the amount of heat provided to the toner layer. Since the amount of heat from the fixing device is dispersed in a larger amount of toner in images with a high print percentage, the amount of toner that is insufficiently melted increases and fixing defects tend to occur.

Furthermore, since the amount of heat provided from the fixing nip portion tends to decrease closer to the trailing end of the image, the fixing performance is likely to degrade at the trailing end of the image.

In particular, the offset phenomenon tends to be more prominent in paper left under a high-temperature and high-humidity environment. When paper that is left under a high-temperature and high-humidity environment and contains a large amount of moisture passes through the fixing device, water vapor is generated from the paper by the heat from the fixing device at the fixing nip portion. The offset phenomenon is presumed to be caused by the water vapor pressing the toner layer on the paper against the fixing film side.

Thus, the offset phenomenon is likely to occur when using a paper left under a high-temperature and high-humidity environment in a state in which a fixing defect easily occurs at the trailing end of the image with a high print percentage.

Improvements such as designing the softening temperature to be low in order to improve the fixing performance of the toner have heretofore been made. However, in such a design, although the hot meltability of the portion to which heat is sufficiently applied is improved, when the amount of heat applied is not sufficient, as at the trailing end of the image with a high print percentage, the melting rate of the toner cannot catch up and occurrence of the trailing end offset in the image with a high print percentage is difficult to suppress.

Meanwhile, new problems relating to viscoelastic properties of the toner may arise, for example, a problem of reducing the storage elastic modulus or loss elastic modulus in a certain temperature range or in a wide range from a low temperature to a high temperature in order to improve the low-temperature fixing performance.

Thus, before and after the toner enters the fixing nip, the toner melts and can sometimes melt and spread too much with respect to the paper. In this case, in particular, when using paper having large unevenness on the surface, the toner on the protrusions which is likely to receive heat from the fixing device preferentially melts and spreads, so that the appearance of the protrusions and the apparent density thereof become different from those in depressions. As a result, an image with conspicuous density unevenness is obtained. This phenomenon is likely to occur in an intermediate gradation (referred to hereinbelow as "halftone") area where shading is particularly conspicuous. As described hereinabove, a toner is required in which occurrence of the trailing end offset of an image with a high print percentage is suppressed even under a high-temperature and high-humidity environment, density unevenness in a halftone image is suppressed and resistance to a severe environment is ensured.

The present invention provides a toner that solves the above problems.

Specifically, a toner is provided such that occurrence of the trailing end offset of an image with a high print percentage can be suppressed even under a high-temperature and high-humidity environment.

Also, a toner is provided such that density unevenness can be suppressed even when a halftone image is outputted.

Furthermore, a toner is provided such that occurrence of fogging can be suppressed even after the toner has been allowed to stand under a high-temperature severe environment.

The present invention provides:

a toner including toner particles, each of which contains a binder resin, a colorant, a wax and a crystalline polyester, wherein a melting point P(t) of the crystalline polyester is at least 65.0° C. and not more than 80.0° C.; and regarding a storage elastic modulus G' obtained in dynamic viscoelasticity measurement of the toner, where G' at 50° C. is denoted by G'(50), G' at 80° C. is denoted by G'(80), G' at 120° C. is denoted by G'(120), and G' at the melting point P(t) of the crystalline polyester is denoted by G'(t), all of the following formulas (1) to (3) are satisfied:

$$4.2\times10^8\ \text{Pa}\leq G'(50) \quad (1)$$

$$3.0\times10^2\leq G'(50)/G'(80) \quad (2)$$

$$G'(t)/G'(120)\leq 7.0\times10^2 \quad (3).$$

The toner of the present invention makes it possible to obtain a high-quality image in which occurrence of the trailing end offset of an image with a high print percentage is suppressed even under a high-temperature and high-humidity environment. Further, even when a halftone image is outputted, it is possible to obtain a high-quality image in which density unevenness is inconspicuous. Furthermore, a high-quality image in which occurrence of fogging is suppressed can be obtained even after the toner has been allowed to stand under a high-temperature severe environment.

Further features of the present invention will become apparent from the following description of exemplary embodiments (with reference to the attached drawings).

BRIEF DESCRIPTION OF THE DRAWINGS

FIG. 6A is a cross-sectional view of the main body of the stirring device, FIG. 6B is a cross-sectional view of the main body of the stirring device, FIG. 6C is a perspective view of a rotor of the stirring device, and FIG. 6D is a perspective view of a stator of the stirring device.

DESCRIPTION OF THE EMBODIMENTS

Figure 1:
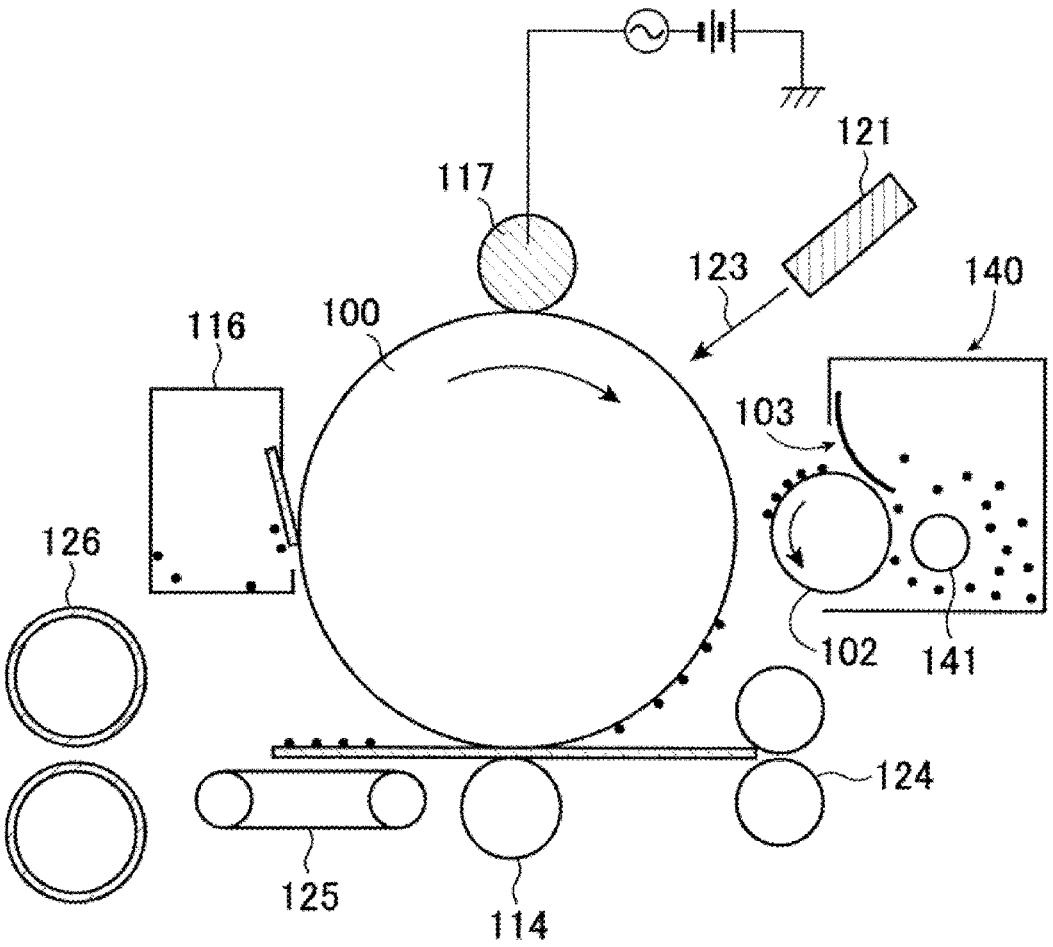
FIG. 1 is a schematic cross-sectional view showing an example of an image forming apparatus.

The present invention will be described hereinbelow in detail, but the present invention is not limited to this description.

In the present invention, the expression "at least x x and not more than x x" or "x x to x x" representing the numerical range means a numerical range including a lower limit and an upper limit which are endpoints, unless specified otherwise.

The toner of the present invention is a toner comprising toner particles, each of which contains a binder resin, a colorant, a wax and a crystalline polyester, wherein a melting point P(t) of the crystalline polyester is at least 65.0° C. and not more than 80.0° C.; and regarding a storage elastic modulus G' obtained in dynamic viscoelasticity measurement of the toner, where G' at 50° C. is denoted by G'(50), G' at 80° C. is denoted by G'(80), G' at 120° C. is denoted by G'(120), and G' at the melting point P(t) of the crystalline polyester is denoted by G'(t), all of the following formulas (1) to (3) are satisfied:

$$4.2\times10^8\ \text{Pa}\leq G'(50) \quad (1)$$

$$3.0\times10^2\leq G'(50)/G'(80) \quad (2)$$

$$G'(t)/G'(120)\leq 7.0\times10^2 \quad (3).$$

In the present invention, an offset occurring at the trailing end of an image (simply referred to hereinbelow as "trailing end offset") is manifested in images with a high print percentage under a high-temperature and high-humidity environment. It is also likely to occur at the trailing end of the image.

As described hereinabove, it is presumed that the offset is more likely to occur in an image with a high print percentage than in an image with a low print percentage due to the amount of heat provided to the toner layer.

Since the amount of heat from the fixing device is dispersed in a larger amount of toner in the image with a high print percentage, the amount of toner that is insufficiently melted increases and fixing defects tend to occur. Moreover, the amount of heat provided from the fixing nip portion decreases gradually toward the trailing end of an image. Thus, the fixing performance is likely to degrade and the trailing end offset is likely to occur at the trailing end of the image.

Further, when paper containing a large amount of moisture passes through the fixing device, water vapor is generated by the heat from the fixing device at the fixing nip portion. Where the fixing performance of the toner is sufficient, since the toner particles are bonded to each other and also fixed to the fibers of the paper, a good image can be obtained even when an image with a high print percentage is outputted. Meanwhile, where the fixing performance of the toner on the paper is insufficient, the water vapor presses the toner against the fixing film side from the paper. As a result, when an image with a high print percentage is outputted, it tends to be an image with small white dots on solid black.

Thus, where paper containing a large amount of moisture, such as paper which has been allowed to stand under a high-temperature and high-humidity environment, is used in a state where the trailing end offset of an image with a high print percentage is likely to occur, a portion with small white dots on solid black is generated at the trailing end of the image. In addition, it has been found that occurrence of the trailing end offset becomes more prominent on paper having large surface unevenness. Furthermore, as a result of microscopic observation of the portion with small white dots on solid black at the trailing end of the image, it was found that white dots on solid black were likely to appear around the depressions on the paper. This is probably because the depressions on the paper are likely to receive less heat than the protrusions from the fixing device, which is also likely to be disadvantageous to the fixing performance of the toner.

Meanwhile, density unevenness which is conspicuous when a halftone image is outputted is also more conspicuous on paper with larger unevenness on the surface.

The protrusions on the paper are apparently more likely to receive heat from the fixing device than the depressions. For example, let us assume that a viscoelastic characteristic is set such that the toner is easy to melt in order to suppress the occurrence of the trailing end offset which is likely to occur around the depressions. As the viscoelastic property, for example, control can be used such that reduces the storage elastic modulus G' as a whole or rapidly decreases the storage elastic modulus G' at about 30° C. to 100° C.

In such a case, before and after the toner enters the fixing nip, the toner melts and sometimes may melt and spread too much on the paper. In particular, when paper with large surface unevenness is used, the toner preferentially melts and spreads on the protrusions which are more likely to receive heat from the fixing device, so that the appearance of the protrusions and the apparent density thereof become different from those of the depressions. As a result, an image with conspicuous density unevenness is obtained. This phenomenon is particularly prominent in halftone images in which shading is conspicuous.

Meanwhile, since the crystalline polyester has a property of being compatible with the binder resin, the crystalline polyester tends to be present on the surface of toner particle, and the charge stability of the toner tends to decrease. In particular, for example, when the toner is transported, the toner is often stored under a high-temperature severe environment, and the crystalline polyester which is compatible with the binder resin is likely to seep out to the surface of the toner particle. As a result, the surface composition of the toner particle is likely to change and fogging becomes prominent.

Further, when the storage elastic modulus G' of the toner is set relatively low in the entire temperature range, for example, embedding of external additives is likely to occur due to the weight of the toner, and flowability of the toner is decreased. In this case, charge-providing performance with respect to the toner is decreased and charge stability of the toner is also decreased at the nip portion between a developing sleeve and a regulating blade. As a result, the electrophotographic characteristics such as fogging are prominently degraded.

It was found that the viscoelastic behavior of the toner needs to be highly controlled in order to suppress effectively the occurrence of the trailing end offset, the occurrence of density unevenness in the halftone image, and the occurrence of fogging after the toner has been allowed to stand under a high-temperature severe environment. This finding led to the completion of the present invention.

Regarding the storage elastic modulus G' obtained in dynamic viscoelasticity measurement of the toner, where G' at 50° C. is denoted by G'(50), G' at 80° C. is denoted by G'(80), G' at 120° C. is denoted by G'(120), and G' at the melting point P(t) of the crystalline polyester is denoted by G'(t), first, it is important that the following formulas (1) and (2) be satisfied simultaneously:

$$4.2\times10^{8}\ \text{Pa} \leq G'(50) \quad (1)$$

$$3.0\times10^{2} \leq G'(50)/G'(80) \quad (2)$$

By controlling G'(50) within the range of formula (1), it is possible to obtain a high-quality image in which the change in the physical properties of the toner is small and the occurrence of fogging is suppressed even after the toner has been allowed to stand under a high-temperature severe environment.

As mentioned hereinabove, G'(50) stands for the storage elastic modulus G' at 50° C., G'(80) stands for the storage elastic modulus G' at 80° C., and G'(120) stands for the storage elastic modulus G' at 120° C.

From the standpoint of ensuring also satisfactory fixing performance, the preferred range of G'(50) is at least $4.2\times10^{8}$ Pa and not more than $1.0\times10^{9}$ Pa, more preferably at least $4.5\times10^{8}$ Pa and not more than $8.0\times10^{8}$ Pa.

Examples of methods for controlling G'(50) within the above range include a method for controlling the physical properties of the binder resin, a method for improving the degree of crystallinity of the crystalline polyester to reduce compatibility with the binder resin, a method for controlling the dispersion state of the magnetic bodies when such is contained as a colorant, and a combination of such methods. For example, adjustment of the amount ratio of polymerizable monomers constituting the binder resin, adjustment of the amount of a polymerization initiator, and adjustment of the amount and type of the crosslinking agent and polymerization conditions can be used to control the physical properties of the binder resin.

Next, by controlling G'(50)/G' (80) within the range of formula (2), it is possible to suppress effectively the occurrence of the trailing end offset even when G'(50) is relatively high as in the present invention.

According to the study conducted by the inventors of the present invention, the occurrence of the trailing end offset could not be effectively suppressed by merely lowering the absolute value of G'(80).

The reason therefor is not clear, but the following explanation can be suggested.

When the temperature of paper in actual printing was measured by the inventors of the present invention, the temperature was about 100° C. to 120° C. in the vicinity of the nip of the fixing device and it was about 80° C. immediately after the paper was discharged from the machine.

Although the process speed of the machine and the temperature control of the fixing device are different for each machine, they are adjusted so as to satisfy the fixing performance of the toner with consideration for the usage environment, and within the range investigated by the inventors of the present invention, the temperature of the paper was approximately within the abovementioned range.

As described hereinabove, it is considered that the amount of heat received by depressions and protrusions is different in the paper with large unevenness, and it is presumed that the heat equivalent to about 80° C. is received at the depressions and the heat equivalent to about 120° C. is received at the protrusions.

Then, the inventors of the present invention analyzed in detail the relationship between the storage elastic modulus G' at 80° C. to 120° C. and the trailing end offset and have found that the occurrence of the trailing end offset can be effectively suppressed by controlling the value of G'(50)/G' (80).

In order to suppress the occurrence of the trailing end offset, it is thought to be important that the elastic modulus of the toner sharply decrease with the temperature rise of the toner at the moment when the toner passes through the nip of the fixing device, and the toner be fixed to the paper, thereby preventing the toner from being held on the fixing film side. Where the process speed is comparatively high, for example about 200 mm/sec, the time for the paper to pass through the fixing device is not more than 0.1 sec. Therefore, it is conceivable that the shortness of this time is simply the reason why the absolute value of G'(80) and the effective suppression of occurrence of the trailing end offset do not correlate with each other.

It is also conceivable that the importance of the value of G' at 80° C. rather than G' at 90° C. or 100° C. is due to this shortness of time.

Thus, it is presumed that the magnitude of the change in elastic modulus from 50° C. at which the elastic modulus begins to decrease to 80° C. is important for effectively suppressing the occurrence of the trailing end offset.

The range of G'(50)/G' (80) is preferably $3.0\times10^2 \leq G'(50)/G'(80) \leq 1.0\times10^3$, and more preferably $4.5\times10^2 \leq G'(50)/G'(80) \leq 1.0\times10^3$. Where the value of G'(50)/G'(80) exceeds $1.0\times10^3$, G' at 80° C. or a higher temperature becomes too low, and the density unevenness of a halftone image is difficult to suppress.

In order to control G'(50)/G'(80) within the above range, in addition to controlling the physical properties of the binder resin, it is possible to adjust of content and type of the crystalline polyester and wax, preferably to control the size of domains of the crystalline polyester and wax such as described hereinbelow.

As a method for controlling the physical properties of the binder resin, for example, it is possible to adjust the amount ratio of the polymerizable monomers constituting the binder resin, the amount of the polymerization initiator, the amount and type of the crosslinking agent, and polymerization conditions.

Further, in the present invention, formula (3) is satisfied simultaneously with formula (2).

$$G'(t)/G'(120) \leq 7.0\times10^2 \quad (3)$$

By controlling the viscoelastic characteristics of the toner so as to satisfy formulas (2) and (3) at the same time, it becomes possible for the first time to suppress the occurrence of the trailing end offset and also suppress the density unevenness of a halftone image.

Here, G'(t) represents the storage elastic modulus G' at the melting point P(t) of the crystalline polyester.

Although the reason why the occurrence of density unevenness in a halftone image can be particularly effectively suppressed by setting the value of G'(t)/G'(120) to not more than $7.0\times10^2$ cannot be clearly understood, the following can be presumed.

As described hereinabove, the protrusions on paper are more likely than the depressions to receive heat from the fixing device, and from the measurement result of the temperature of the paper, it seems that heat corresponding to about 120° C. is instantly applied.

The reason why the density unevenness appears is presumably that the toner at the protrusions which are likely to receive more heat from the fixing device melts and spreads preferentially to the toner in the depressions, so that the appearance of the protrusions and the apparent density thereof differ from those of the depressions. As a result, density unevenness becomes conspicuous.

Where the paper passes through the fixing nip, when the toner reaches the melting point of the crystalline polyester, the binder resin is plasticized by the crystalline polyester, and significant deformation of the shape thereof is started.

It is also conceivable that the toner in the depressions on the paper is less likely than the toner at the protrusions to receive pressure, rather than heat alone, in the nip of the fixing device.

Where the value of G'(t)/G'(120) is not more than $7.0\times10^2$, it means that the change in the storage elastic modulus close to a temperature of 120° C. which is received by the protrusions on the paper is relatively small after the crystalline polyester begins plasticizing the toner close to the melting point of the crystalline polyester.

At the moment when the toner passes through the nip of the fixing device, the toner at the protrusions is likely to receive heat at about 120° C. and also to receive pressure. Therefore, where the viscoelastic characteristic of the toner is not highly controlled, as described hereinabove, the toner at the protrusions melts and spreads excessively, which tends to cause density unevenness.

As described hereinabove, the results obtained in actually measuring the temperature of the paper demonstrated that the paper temperature was around 80° C. immediately after the paper which passed through the fixing nip was discharged from the machine.

Thus, it is presumed that even after passing through the fixing nip, the toner plasticized by the crystalline polyester is somewhat deformed.

From these facts, it follows that the toner in the depressions continues to deform in a state in which it is unlikely to receive pressure before and after the fixing nip, whereas the toner at the protrusions is pressurized while receiving heat of about 120° C. in the fixing nip portion.

Thus, it is important for suppression of density unevenness that the manner of deformation of the toner at the depressions and protrusions, which are differently affected by heat and pressure, does not differ greatly.

Therefore, the inventors of the present invention think that not only the absolute value of G'(120), but also G'(t)/G'(120) is important.

Thus, as described hereinabove, it is considered that the protrusions of the paper are more likely than the depressions to receive heat from the fixing device. For example, let us assume that a viscoelastic characteristic is set such that the toner is easy to melt in order to suppress the occurrence of the trailing end offset which is likely to occur around the depressions. As the viscoelastic property, for example, control can be used such that reduces G' as a whole or control can be used such that rapidly decreases G' at about 30° C. to 100° C.

In such a case, the toner at the protrusions is likely to melt and spread excessively, and the appearance of the protrusions and the apparent density thereof become different from those of the depressions. As a result, density unevenness becomes conspicuous.

The value of G'(t)/G'(120) is preferably at least $1.5\times10^2$ and not more than $7.0\times10^2$, and more preferably at least $2.0\times10^2$ and not more than $6.5\times10^2$. When the value of G'(t)/G'(120) is less than $1.5\times10^2$, it is possible to suppress the occurrence of the trailing end offset and also to suppress of occurrence of fogging after the toner has been allowed to stand under a high-temperature severe environment by controlling G'(50) to a low value.

In order to control G'(t)/G'(120) within the above range, in addition to adjusting the physical properties of the binder resin, for example, controlling the tetrahydrofuran (THF) insoluble content of the binder resin, it is possible to adjust the content and type of the crystalline polyester and wax.

Other preferred examples include the control of the size of domains of the crystalline polyester and wax which will be described hereinbelow, and the control of the dispersion state of the magnetic bodies when such are used as a colorant, as described hereinbelow.

In the present invention, in cross-sectional observations of each of the toner particles under a scanning transmission electron microscope, domains of the crystalline polyester are present in the cross section of each of the toner particles; and a number-average long diameter of the domains is preferably at least 5 nm and not more than 500 nm, and the number of domains per cross section of each of the toner particles is preferably at least 8 and not more than 500.

The number-average long diameter of the domains of the crystalline polyester is more preferably at least 10 nm and not more than 300 nm, and the number of domains is more preferably at least 50 and not more than 500.

In the present invention, the cross section of the toner particle is stained with ruthenium, and lamellas of the stained crystalline polyester can be observed by observations under a scanning transmission electron microscope (STEM).

One shape constituting this lamella is called a domain. Thus, in the present invention, a plurality of relatively small domains is formed in the toner, the domain of the crystalline polyester being the abovementioned shape. A state in which such domains of a small size (referred to hereinbelow as "small domains") are present inside the toner is called "small domains are dispersed". When the toner receives the heat of the fixing device and the melting point of the crystalline polyester is exceeded, the small domains finely dispersed in the toner particle are instantly softened, so that the entire toner particle is easily softened, and the occurrence of the trailing end offset can be effectively suppressed.

Figure 2:
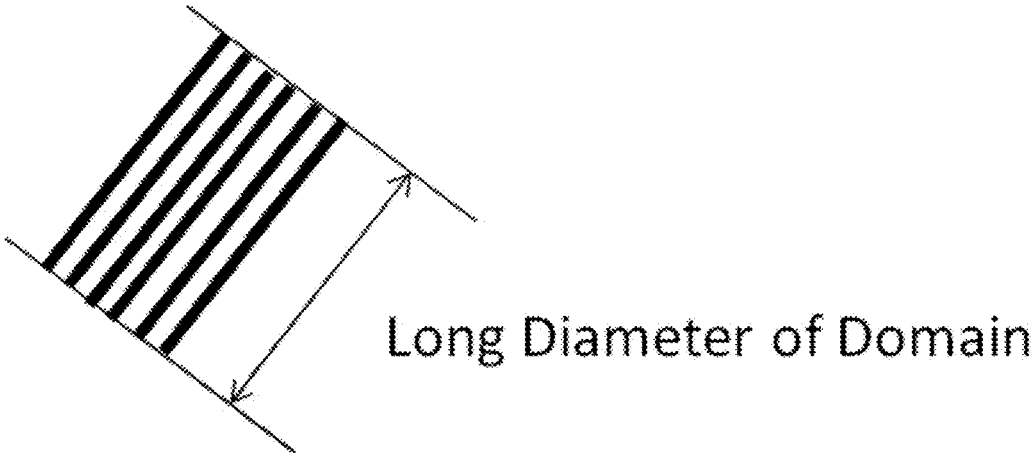
FIG. 2 is a schematic view showing the domain shape of a crystalline polyester.

FIG. 2 is a schematic view of the domain of the crystalline polyester observed in the cross section of a toner particle. When the size and the number of domains of the crystalline polyester are within the abovementioned ranges, the entire toner particle is likely to soften instantly close to the melting point of the crystalline polyester and can be easily controlled to the viscoelastic characteristic range of the present invention.

In the present invention, it is important that wax be included in addition to the crystalline polyester.

The size and number of domains of the crystalline polyester can be adjusted by the content and type of the crystalline polyester and wax and the below-described method for producing the toner.

Specifically, crystal nuclei of the wax are formed in the entire binder resin by crystallization after the wax has been compatibilized in the binder resin of the toner. By crystallizing thereafter the crystalline polyester at the crystal nuclei as starting points, it is possible to obtain a state in which small domains of the crystalline polyester, which are of a relatively small size, are dispersed in the whole toner.

The crystalline polyester will be described hereinbelow.

In the present invention, the crystalline polyester is not particularly limited, and well-known crystalline polyesters can be used, but saturated polyesters are preferred.

Further, the crystalline polyester is preferably a condensate of an aliphatic dicarboxylic acid, an aliphatic diol, and an aliphatic monocarboxylic acid. The inclusion of the aliphatic monocarboxylic acid as a constituent component of the crystalline polyester is preferable because it makes it easy to adjust the molecular weight and hydroxyl value of the crystalline polyester and also makes it possible to control the affinity with the wax.

The following examples illustrate monomers that can be used in the case where the crystalline polyester is a condensate of an aliphatic dicarboxylic acid, an aliphatic diol, and an aliphatic monocarboxylic acid and is a saturated polyester.

Further, the crystalline polymer, as referred to in the present invention, indicates a polymer in which a definite endothermic peak (melting point) is observed in a reversible specific heat change curve obtained by measuring specific heat changes by using a differential scanning calorimeter.

Examples of the aliphatic dicarboxylic acid include oxalic acid, malonic acid, succinic acid, glutaric acid, adipic acid, pimelic acid, suberic acid, azelaic acid, sebacic acid, dodecanedioic acid, hexadecane dicarboxylic acid, and octadecane dicarboxylic acid.

Examples of the aliphatic diol include ethylene glycol, diethylene glycol, triethylene glycol, 1,2-propane diol, 1,3-propane diol, dipropylene glycol, trimethylene glycol, neopentyl glycol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,16-hexadecanediol, and 1,18-octadecanediol.

Examples of the aliphatic monocarboxylic acid include decanoic acid (capric acid), dodecanoic acid (lauric acid), tetradecanoic acid (myristic acid), hexadecanoic acid (palmitic acid), octadecanoic acid (stearic acid), eicosanoic acid (arachidic acid), docosanoic acid (behenic acid), and tetracosanoic acid (lignoceric acid).

Here, since a monocarboxylic acid has one carboxyl group, a structure derived from the monocarboxylic acid is located at the end of the molecular chain of the crystalline polyester.

Where the crystalline polyester is used, the affinity with the wax is enhanced. As a result, the crystalline polyester is shaped to cover the wax, the domains of the crystalline polyester tend to become thermally stable, and fogging hardly occurs even after the toner is allowed to stand under a high-temperature severe environment. Furthermore, as a result of simultaneous melting of the crystalline polyester and the wax, the surrounding binder resin is instantly plasticized, whereby the effect of suppressing the occurrence of the trailing end offset is likely to be synergistically improved.

By using the crystalline polyester such as described hereinabove, it is possible to improve both the trailing end offset and durability under a severe environment, which are in a trade-off relationship.

In particular, it is preferable that a crystalline polyester having an alkyl group with 10 to 24 carbon atoms at the end thereof be used together with an ester wax having 2 to 6 ester groups in one molecule because the coverage of the wax by the crystalline polyester is dramatically increased due to a high affinity therebetween.

In the present invention, a crystalline polyester having a structure derived from an acid monomer selected from lauric acid, stearic acid, and behenic acid at the molecular chain end is preferred because the affinity with the above-mentioned ester wax is further enhanced and the coverage ratio of the wax with the crystalline polyester also tends to increase.

As will be described later in detail, this tendency is likely to increase advantageously with the increase in a cooling rate in a cooling step during a toner production process.

From the viewpoint of crystallinity of the crystalline polyester, the content of a straight-chain aliphatic dicarboxylic acid in the total carboxylic acid component is preferably at least 80 mol %, more preferably at least 90 mol %, and even more preferably at least 95 mol %.

From the viewpoint of crystallinity of the crystalline polyester, the content of a straight-chain aliphatic diol in the total polyol component is preferably at least 80 mol %, more preferably at least 90 mol %, and even more preferably 100 mol %.

In the present invention, the melting point P(t) of the crystalline polyester is at least 65.0° C. and not more than 80.0° C., and preferably at least 65.0° C. and not more than 75.0° C. Since the melting point P(t) is determined by the combination of the carboxylic acid component and the alcohol component to be used, the melting point can be adjusted to fall within the abovementioned range by appropriately selecting the combination.

Here, when a plurality of crystalline polyesters is included, the melting point of the crystalline polyester having a lower melting point is defined as P(t).

In the present invention, when P(t) is less than 65.0° C., even when the viscoelastic characteristic of the toner is within the abovementioned range, the crystalline polyester is likely to seep out to the toner surface under a severe environment. As a result, the toner charging performance becomes nonuniform, so that it is difficult to suppress the occurrence of fogging after the toner has been allowed to stand under a high-temperature severe environment.

Meanwhile, when P(t) exceeds 80.0° C., the timing at which the crystalline polyester plasticizes the surrounding binder resin at the fixing nip is delayed, so that it is difficult to suppress the occurrence of the trailing end offset.

The crystalline polyester can be produced by a usual polyester synthesis method. For example, it can be obtained by conducting an esterification reaction or a transesterification reaction of a dicarboxylic acid component and a diol component and then conducting a polycondensation reaction by a conventional method under reduced pressure or by introducing nitrogen gas.

At the time of the esterification or transesterification reaction, a usual esterification catalyst or transesterification catalyst such as sulfuric acid, tertiary butyl titanium butoxide, dibutyltin oxide, manganese acetate, and magnesium acetate, can be used as required. Regarding the polymerization, it is also possible to use a usual polymerization catalyst, for example, a known catalyst such as tertiary butyl titanium butoxide, dibutyltin oxide, tin acetate, zinc acetate, tin disulfide, antimony trioxide, and germanium dioxide. The polymerization temperature and the catalyst amount are not particularly limited, and they may be arbitrarily selected as required.

As the catalyst, it is preferable to use a titanium catalyst, and a chelate type titanium catalyst is more preferred. This is because the reactivity of the titanium catalyst is appropriate and a polyester having an appropriate molecular weight distribution can be obtained.

The weight average molecular weight (Mw) of the crystalline polyester is preferably at least 10,000 and not more than 60,000, and more preferably at least 25,000 and not more than 45,000.

It is preferred that the weight average molecular weight (Mw) of the crystalline polyester satisfy the abovementioned range because the crystalline polyester is likely to undergo phase separation with the binder resin in the toner production process, and durability of the toner under a high-temperature severe environment is increased.

The weight average molecular weight (Mw) of the crystalline polyester can be controlled by various production conditions of the crystalline polyester.

The hydroxyl value (mg KOH/g) of the crystalline polyester is preferably controlled to be low from the viewpoint of increasing the coverage ratio of the wax with the crystalline polyester. This is apparently because the crystalline polyester with fewer OH groups has higher affinity with the wax. Specifically, the hydroxyl value is preferably not more than 40.0 mg KOH/g, more preferably not more than 30.0 mg KOH/g, and still more preferably not more than 10.0 mg KOH/g.

Further, regarding the acid value (mg KOH/g) of the crystalline polyester, the acid value is preferably controlled to be low, similarly to the hydroxyl value, from the viewpoint of increasing the coverage ratio of the wax with the crystalline polyester. Specifically, it is preferably not more than 8.0 mg KOH/g, more preferably not more than 5.0 mg KOH/g, and even more preferably not more than 4.5 mg KOH/g.

In the present invention, the binder resin is not particularly limited, and the below-described known resins suitable for toners can be used.

Homopolymers of styrene and substitution products thereof such as polystyrene and polyvinyl toluene; styrene copolymers such as styrene-propylene copolymer, styrene-vinyl toluene copolymer, styrene-vinyl naphthalene copolymer, styrene-vinyl methyl ether copolymer, styrene-vinyl ethyl ether copolymer, styrene-vinyl methyl ketone copolymer, styrene-butadiene copolymer, styrene-isoprene copolymer, styrene-maleic acid copolymer, and styrene-maleic acid ester copolymer; styrene acrylic resins such as styrene-methyl acrylate copolymer, styrene-ethyl acrylate copolymer, styrene-butyl acrylate copolymer, styrene-octyl acrylate copolymer, styrene-dimethylaminoethyl acrylate copolymer, styrene-methyl methacrylate copolymer, styrene-ethyl methacrylate copolymer, styrene-butyl methacrylate copolymer, and styrene-dimethylaminoethyl methacrylate copolymer; polymethyl methacrylate, polybutyl methacrylate, polyvinyl acetate, polyethylene, polypropylene, polyvinyl butyral, silicone resins, polyester resins, polyamide resins, epoxy resins, and polyacrylic acid resins may be used, and these may be used individually or in combinations of a plurality thereof. Among them, from the viewpoints of development characteristics, fixing performance, or the like, the binder resin is preferably a styrene acrylic resin exemplified by styrene-butyl acrylate and styrene-butyl methacrylate.

As described hereinabove, it is preferable that the binder resin include a styrene acrylic resin as a main component. Specifically, the content of the styrene acrylic resin in the binder resin is preferably at least 50% by mass and not more than 100% by mass, more preferably at least 70% by mass and not more than 100% by mass, still more preferably at least 85% by mass and not more than 100% by mass, and particularly preferably at least 90% by mass and not more than 100% by mass.

Here, in the present invention, the crystalline polyester is not considered as a binder resin.

Since the crystalline polyester has a property of being easily compatible with the binder resin, the crystalline polyester is likely to be present on the surface of the toner particle, and the charge stability of the toner is likely to be lowered. For example, when the toner is stored under a high-temperature severe environment, e.g., when the toner is transported, the crystalline polyester compatibilized with the binder resin is likely to seep out to the surface of the toner particle.

Further, the case where an amorphous polyester resin, which is more likely to be compatible with the crystalline polyester, is taken as the main component of the binder resin is likely to be disadvantageous in this respect.

Also, because of high compatibility with the amorphous polyester resin, the higher is the content of the amorphous polyester resin, the harder it is to control the viscoelastic characteristics to the preferable ranges of the present invention.

Therefore, since a styrene acrylic resin is unlikely to be compatibilized with the crystalline polyester, it is easy to increase the degree of crystallinity of the crystalline polyester, and it is preferable that the styrene acrylic resin be used as the main component of the binder resin.

In the present invention, the tetrahydrofuran (THF) insoluble content of the toner is preferably at least 8% by mass and not more than 50% by mass, and more preferably at least 15% by mass and not more than 45% by mass, based on the total amount of the resin component.

When the THF insoluble content of the toner satisfies the abovementioned range, it is easy to control the viscoelastic properties of the toner. In particular, it becomes easier to control the value of G'(t)/G'(120) within the abovementioned range.

The THF insoluble content of the toner can be adjusted by the amount and type of a crosslinking agent added at the time of polymerizing the polymerizable monomers constituting the binder resin and the polymerization conditions.

Further, in the present invention, in the molecular weight distribution (measured by gel permeation chromatography) of tetrahydrofuran (THF) solubles of the toner, the peak molecular weight (Mp) is preferably at least 12,000 and not more than 28,000, and more preferably at least 15,000 and not more than 26,000.

When the peak molecular weight (Mp) is within the abovementioned range, the viscoelastic properties of the toner are easily controlled. Further, the peak molecular weight (Mp) can be adjusted by the amount and type of a polymerization initiator added at the time of polymerizing the polymerizable monomers constituting the binder resin, and the polymerization conditions.

In the present invention, as described hereinabove, the domains of the crystalline polyester are present in the cross section of each of the toner particles observed under a scanning transmission electron microscope, the number average long diameter of the domains is preferably at least 5 nm and not more than 500 nm, and the number of domains is preferably at least 8 and not more than 500.

When the number average particle diameter and the number of domains are within the abovementioned ranges, it is easy to control the viscoelastic properties preferable in the present invention.

The presence of the domains indicates that the degree of crystallinity of the crystalline polyester is relatively high, which is preferable in terms of controlling the value of G'(50) within the abovementioned range. In addition, the domains are preferable in terms of facilitating the plasticization of the surrounding binder resin and controlling the value of G'(50)/G'(80) within the abovementioned range.

The size and number of domains can be adjusted by the content and type of the crystalline polyester and wax and by the below-described method for producing the toner.

In the present invention, the wax is not particularly limited, and the following waxes can be used.

Specific examples of suitable waxes include aliphatic hydrocarbon waxes such as low-molecular-weight polyethylene, low-molecular-weight polypropylene, microcrystalline wax, Fischer-Tropsch wax, and paraffin wax; oxides of aliphatic hydrocarbon waxes such as oxidized polyethylene wax and block copolymers thereof; waxes mainly composed of fatty acid esters such as carnauba wax and montanic acid ester wax, and waxes obtained by partial or complete deacidification of fatty acid esters, such as deacidified carnauba wax; saturated straight-chain fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissil alcohol; polyhydric alcohols such as sorbitol; fatty acid amides such as linoleic acid amide, oleic acid amide, and lauric acid amide; saturated fatty acid bis-amides such as methylene-bis-stearic acid amide, ethylene-bis-caprylic acid amide, ethylene-bis-lauric acid amide, and hexamethylene-bis-stearic acid amide; unsaturated fatty acid amides such as ethylene-bis-oleic acid amide, hexamethylene-bis-oleic acid amide, N,N'-dioleyl adipic acid amide, and N,N'-dioleyl sebacic acid amide; aromatic bis-amides such as m-xylene-bis-stearic acid amide and N,N'-distearyl isophthalic acid amide; aliphatic metal salts such as calcium stearate, calcium laurate, zinc stearate, and magnesium stearate (commonly referred to as metal soaps); waxes obtained by using a vinyl monomer, such as styrene, or acrylic acid to graft to an aliphatic hydrocarbon wax; partially esterified products of a fatty acid and a polyhydric alcohol, such as behenic acid monoglyceride; and methyl ester compounds having a hydroxyl group obtained by hydrogenation of vegetable oils and fats. These waxes may be used individually or in combinations of two or more thereof.

As described hereinabove, crystal nuclei of wax are formed in the entire binder resin by crystallization after compatibilizing wax in the binder resin of the toner. By thereafter crystallizing the crystalline polyester, starting from the crystal nuclei, it is possible to obtain a state in which small domains of the crystalline polyester of a relatively small size are dispersed in the whole toner.

Thus, by using a wax easily compatible with the binder resin, it becomes easier to control the presence state of the domains of the crystalline polyester (the number average long diameter and the number of domains) to a desired state.

From the viewpoint of high compatibility with the binder resin, it is preferred that the wax be an ester wax. From the viewpoint of enabling the increase in the degree of crystallinity of the crystalline polyester and facilitating the control to the desired presence state, it is also preferred that the wax be an ester wax.

The ester wax is more preferably an ester compound of a divalent alcohol and an aliphatic monocarboxylic acid, or an ester compound of a divalent carboxylic acid and an aliphatic monoalcohol (sometimes referred to hereinbelow as "bifunctional ester wax"). Here, when there is one ester bond in one molecule of the ester compound, the compound is represented as monofunctional, and when n ester groups are present, the compound is represented as n-functional.

It is further preferable that the ester wax be a bifunctional ester wax represented by the following formula (I) or the following formula (II).

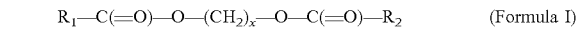

$$R_1—C(=O)—O—(CH_2)_x—O—C(=O)—R_2 \quad \text{(Formula I)}$$

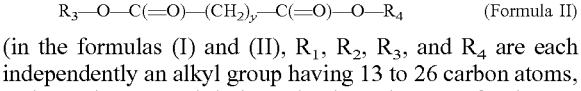

$$R_3—O—C(=O)—(CH_2)_y—C(=O)—O—R_4 \quad \text{(Formula II)}$$

(in the formulas (I) and (II), $R_1$, $R_2$, $R_3$, and $R_4$ are each independently an alkyl group having 13 to 26 carbon atoms, and x and y are each independently an integer of at least 4 and not more than 18 (preferably, at least 8 and not more than 10).

According to the study conducted by the inventors of the present invention, a bifunctional ester wax easily acts as a nucleating agent for a crystalline polyester, easily causes the crystallization of the domains of the crystalline polyester inside the toner, and makes it easy to control the domains to the desired state.

Specifically, by using the bifunctional ester wax, it is possible to control the number average long diameter of the domains of the crystalline polyester to a relatively small range of from at least 5 nm to not more than 500 nm, and to control the number of domains of the crystalline polyester to a relatively large range of from at least 8 to not more than 500.

Specific examples of the divalent carboxylic acid include decanedioic acid (sebacic acid) and dodecanedioic acid. Examples of the dihydric alcohol include 1,8-octanediol, 1,9-nonanediol and 1,10-decanediol. Here, straight chain aliphatic carboxylic acids and straight chain alcohols are exemplified, but they may have a branched structure.

Specific examples of aliphatic monocarboxylic acids and aliphatic monoalcohols are presented below.

Examples of aliphatic monocarboxylic acids include myristic acid, palmitic acid, margaric acid, stearic acid, tuberculostearic acid, arachidic acid, behenic acid, lignoceric acid, and cerotic acid.

Examples of aliphatic monoalcohols include tetradecanol, pentadecanol, hexadecanol, heptadecanol, octadecanol, nonadecanol, eicosanol, docosanol, tricosanol, tetracosanol, pentacosanol, and hexacosanol.

In the present invention, it is preferable to use waxes in combination in order to obtain the desired viscoelastic characteristics. In addition to the wax serving to act as a nucleating agent for the crystalline polyester, as described hereinabove, it is preferable to include a wax capable of forming a domain of a relatively large size (also referred to as "large domain") in the toner particle.

Thus, in cross-sectional observations of each of the toner particles under a scanning transmission electron microscope, a domain of the wax is present in the cross section of each of the toner particles;

a maximum diameter of the domain is preferably at least 1.0 μm and not more than 5.0 μm; and a proportion of an area of the domain of the wax to an area of the cross section of each of the toner particles is preferably at least 10.0% by area and not more than 60.0% by area.

The maximum diameter of the large domain is more preferably at least 1.0 μm and not more than 4.0 μm, and still more preferably at least 1.0 μm and not more than 3.6 μm.

Further, the proportion of the area of the large domain of the wax to the area of the cross section of each of the toner particles is more preferably at least 10.0% by area and not more than 40.0% by area, and still more preferably at least 10.0% by area and not more than 38.5% by area.

When the maximum diameter of the large domain and the proportion of the area occupied by the large domain to the area of the cross section of the toner particle are within the abovementioned ranges, the viscoelastic characteristics are easier to control.

The wax preferably used to form a large domain is a wax which is relatively incompatible with the binder resin. Such a wax is likely to form a large domain of the wax in a state of phase separation from the binder resin inside the toner.

Examples of waxes that are likely to form such a large domain include aliphatic hydrocarbon waxes such as low-molecular-weight polyethylene, low-molecular-weight polypropylene, microcrystalline wax, Fischer-Tropsch wax, and paraffin wax.

The aliphatic hydrocarbon wax may be modified, e.g., by the addition of a hydroxyl group. Furthermore, the acid value of the aliphatic hydrocarbon wax is preferably at least 0.0 mg KOH/g and not more than 20.0 mg KOH/g, and more preferably at least 0.05 mg KOH/g and not more than 10.0 mg KOH/g.

Thus, in the present invention, it is more preferable that the wax include an ester wax and an aliphatic hydrocarbon wax.

The size of the large domain can be controlled by controlling, for instance, the type and amount of the crystalline polyester to be added, the type and amount of the wax to be added, and the cooling step during the below-described production of the toner.

In the present invention, the content of the wax contained in the toner particle is preferably at least 2.5 parts by mass and not more than 35.0 parts by mass, more preferably at least 4.0 parts by mass and not more than 30.0 parts by mass, and even more preferably at least 6.0 parts by mass and not more than 25.0 parts by mass with respect to 100 parts by mass of the binder resin as a total amount.

The content of the ester wax contained in the toner particle is preferably at least 3.0 parts by mass and not more than 20.0 parts by mass, and more preferably at least 5.0 parts by mass and not more than 15.0 parts by mass with respect to 100 parts by mass of the binder resin.

Further, the content ratio [ester wax:aliphatic hydrocarbon wax] of the ester wax and the aliphatic hydrocarbon wax is preferably 2:8 to 8:2, and more preferably 3:7 to 7:3, on a mass basis.

In the present invention, the content of the crystalline polyester contained in the toner particle is preferably at least 3.0 parts by mass and not more than 15.0 parts by mass, preferably at least 3.0 parts by mass and not more than 12.0 parts by mass, and more preferably at least 3.0 parts by mass and not more than 10.0 parts by mass with respect to 100 parts by mass of the binder resin as a total amount.

When the content of the crystalline polyester is within the abovementioned ranges, the viscoelastic characteristics are easy to control and it is possible to control more appropriately the seeping of the crystalline polyester to the surface of the toner particle.

Further, the ratio of the content of the crystalline polyester to the content of the wax in the toner particle [(content of the crystalline polyester)/(content of the wax)] is preferably at least 0.30 and not more than 1.00, and more preferably at least 0.30 and not more than 0.70 on a mass basis.

When the content of the crystalline polyester is within the abovementioned ranges and the ratio of the content of the crystalline polyester to the content of the wax in the toner particle is within the abovementioned ranges, the viscoelastic characteristics are easy to control.

In the present invention, where the melting point of the wax is denoted by W(t) and the melting point of the crystalline polyester is denoted by P(t), it is preferable that W(t) and P(t) satisfy the following formula (4):

$$-10.0^\circ\ \text{C.} \leq \{W(t)-P(t)\} \leq 20.0^\circ\ \text{C.} \quad (4)$$

Here, when the toner particle includes a plurality of waxes, the melting point of the wax having the melting point closest to the melting point P(t) of the crystalline polyester is defined as W(t).

The relationship between W(t) and P(t) is preferably $-5.0^\circ$ C.$\leq\{W(t)-P(t)\}\leq 10.0^\circ$ C., and more preferably $-2.0^\circ$ C.$\leq\{W(t)-P(t)\}\leq 8.0^\circ$ C.

In the present invention, from the standpoint of obtaining the effect of suppressing the occurrence of the trailing end offset and also realizing other characteristics, W(t) is preferably at least 65.0° C. and not more than 85.0° C., and more preferably at least 65.0° C. and not more than 80.0° C.

When {W(t)−P(t)} is in the abovementioned ranges, the difference between W(t) and P(t) is relatively small. At this time, the wax and the crystalline polyester melt almost at the same time before and after entering the fixing nip. As a result, the surrounding binder resin can be instantly plasticized and the effect of suppressing the occurrence of the trailing end offset is likely to be synergistically improved.

The structure, physical properties, and content of the crystalline polyester and wax used in the present invention are specified by the following methods.

First, the toner is extracted with tetrahydrofuran, and most of the resin component is removed. Here, components other than the resin, such as the magnetic bodies and the external additive, are removed by centrifugal separation utilizing the difference in specific gravity. Since the remaining resin component is a mixture of the crystalline polyester and wax, each of the crystalline polyester and wax is isolated by preparative liquid chromatography (LC), and structural analysis thereof is performed using nuclear magnetic resonance spectroscopy ($^1$H-NMR), or the like, to specify physical properties such as structure and melting point.

Further, the content in the toner is determined as follows. For example, the content of the crystalline polyester is obtained by comparing nuclear magnetic resonance spectroscopic analysis results of the toner and the crystalline polyester after fractionation and obtaining the area ratio of the peak characteristic for the crystalline polyester. The content of the wax likewise can be obtained on the basis of the peak area ratio which is the result of nuclear magnetic resonance spectroscopic analysis.

In the present invention, the toner particle includes a colorant. Examples of the colorant include the following organic pigments, organic dyes, and inorganic pigments.

Examples of cyan colorants include copper phthalocyanine compounds and derivatives thereof, anthraquinone compounds, and basic dye lake compounds. Specific examples of the colorants are presented below. C. I. Pigment Blue 1, 7, 15, 15:1, 15:2, 15:3, 15:4, 60, 62 and 66. Examples of magenta colorants are presented below. Condensed azo compounds, diketopyrrolopyrrole compounds, anthraquinone compounds, quinacridone compounds, basic dye lake compounds, naphthol compounds, benzimidazolone compounds, thioindigo compounds, and perylene compounds. Specific examples of the colorants are presented below. C. I. Pigment Red 2, 3, 5, 6, 7, 23, 48:2, 48:3, 48:4, 57:1, 81:1, 122, 144, 146, 150, 166, 169, 177, 184, 185, 202, 206, 220, 221, 254, and C. I. Pigment Violet 19.

Examples of yellow colorants include condensed azo compounds, isoindolinone compounds, anthraquinone compounds, azo metal complexes, methine compounds, and an allyl amide compounds. Specific examples of the colorants are presented below. C. I. Pigment Yellow 12, 13, 14, 15, 17, 62, 74, 83, 93, 94, 95, 97, 109, 110, 111, 120, 127, 128, 129, 147, 151, 154, 155, 168, 174, 175, 176, 180, 181, 185, 191, and 194.

Examples of black colorants include carbon black, magnetic bodies, and colorants which have been color toned to black by using the abovementioned yellow colorants, magenta colorants, and cyan colorants.

These colorants can be used individually or in mixtures or in a solid solution state. The colorant used in the present invention is selected from the viewpoints of hue angle, chroma, lightness, lightfastness, OHP transparency and dispersibility in toner particle.

Where magnetic bodies are used as a colorant in the toner of the present invention, the magnetic body is mainly composed of magnetic iron oxide such as triiron tetroxide or γ-iron oxide, and may include elements such as phosphorus, cobalt, nickel, copper, magnesium, manganese, aluminum, and silicon. The BET specific area of these magnetic bodies determined by a nitrogen adsorption method is preferably 2 $m^2/g$ to 30 $m^2/g$, and more preferably 3 $m^2/g$ to 28 $m^2/g$. Also, the magnetic bodies having Mohs hardness of 5 to 7 are preferred.

The magnetic bodies may have a polyhedron, octahedron, hexahedron, spherical, needle-like, or scale-like shape, but those with less anisotropy, such as polyhedron, octahedron, hexahedron, and spherical shape are preferred because image density is increased.

The amount of the colorant added is preferably at least 1 part by mass and not more than 20 parts by mass with respect to 100 parts by mass of the binder resin. Where magnetic bodies are used, the amount thereof is preferably at least 20 parts by mass and not more than 200 parts by mass, and more preferably at least 40 parts by mass and not more than 150 parts by mass with respect to 100 parts by mass of the binder resin.

From the viewpoint of uniform dispersibility in toner particles and tinge, it is preferred that the number average particle diameter of primary particles of the magnetic bodies be 0.10 μm to 0.40 μm.

The number average particle diameter of the magnetic bodies can be measured using a scanning transmission electron microscope. Specifically, after sufficiently dispersing the toner particles, which are to be observed, in the epoxy resin, the toner is cured for 2 days in an atmosphere at a temperature of 40° C. The cured product obtained is sliced into flaky samples with a microtome, a cross-sectional image is captured at a magnification of 10,000 to 40,000 times by using a scanning transmission electron microscope (STEM), and the particle diameter of 100 magnetic bodies in the cross-sectional image is measured. Then, the number average particle diameter (D1) is calculated on the basis of the equivalent diameter of a circle equal to the projected area of the magnetic body. The particle diameter may be also measured by an image analysis apparatus.

The magnetic bodies can be produced, for example, by the following method.

First, an aqueous solution including ferrous hydroxide is prepared by adding an alkali such as sodium hydroxide in an amount equivalent to the iron component or a larger amount to an aqueous ferrous salt solution. Air is then blown while maintaining the pH of the prepared aqueous solution at at least 7.0, the ferrous hydroxide is oxidized while warming the aqueous solution to at least 70° C., and the seed crystals serving as cores of the magnetic iron oxide particles are generated.

Next, an aqueous solution including about 1 equivalent of ferrous sulfate, on the basis of the amount of alkali which has been heretofore added, is added to the slurry including the seed crystals. Then, the reaction of ferrous hydroxide is advanced while maintaining the pH of the resulting mixture at least 5.0 and not more than 10.0 and blowing air, and magnetic iron oxide particles are grown with the seed crystals as the cores. At this time, it is possible to control the shape and magnetic properties of the magnetic iron oxide by selecting an arbitrary pH, reaction temperature, and stirring conditions. As the oxidation reaction progresses, the pH of the mixed solution shifts to the acidic side, but it is preferred that the pH of the mixed solution be not less than 5.0.

After completion of the oxidation reaction, a silicon source such as sodium silicate is added, the pH of the mixed solution is adjusted to at at least 5.0 and not more than 8.0, and a coating layer of silicon is formed on the surface of the magnetic iron oxide particles. Magnetic iron oxide (magnetic bodies) can be obtained by filtering, washing and drying the obtained magnetic iron oxide particles by a conventional method.

Further, when a toner particle is produced in an aqueous medium in the present invention, it is preferable to subject the surface of the magnetic bodies to hydrophobic treatment.

When the hydrophobic treatment is carried out by a dry process, the magnetic iron oxide which has been washed, filtered and dried is subjected to the hydrophobic treatment by using a coupling agent.

In the case of carrying out the hydrophobic treatment by a wet process, the magnetic iron oxide obtained as described hereinabove is redispersed in an aqueous medium, or the magnetic iron oxide obtained by washing and filtration is redispersed, without drying, in another aqueous medium, and treatment with a coupling agent is carried out. In the present invention, both the dry process and the wet process can be selected as appropriate.

Examples of the coupling agent that can be used for the hydrophobic treatment of the magnetic bodies include a silane coupling agent and a titanium coupling agent. Preferably, it is a silane coupling agent represented by the following general formula (III).

$$R_mSiY_n \qquad \text{Formula (III)}$$

(In the formula (III), R represents an alkoxy group or a hydroxyl group, Y represents an alkyl group, a phenyl group or a vinyl group, and the alkyl group may have an amino group, a hydroxyl group, an epoxy group, an acryl group, or a methacryl group as a substituent; m represents an integer of 1 to 3, and n represents an integer of 1 to 3. However, m+n=4).

Examples of the silane coupling agent represented by the formula (III) include vinyltrimethoxysilane, vinyltriethoxysilane, vinyltris(β-methoxyethoxy)silane, β-(3,4 epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-propyltrimethoxysilane, isopropyltrimethoxysilane, n-butyltrimethoxysilane, isobutyltrimethoxysilane, trimethylmethoxysilane, n-hexyltrimethoxysilane, n-octyltrimethoxysilane, n-octyltriethoxysilane, n-decyltrimethoxysilane, hydroxypropyltrimethoxysilane, n-hexadecyltrimethoxysilane, n-octadecyltrimethoxysilane, and hydrolyzates thereof. In the present invention, the silane coupling agents in which Y in formula (III) is an alkyl group are preferred. The preferred among these are the silane coupling agents in which the alkyl group has 3 to 6 carbon atoms, and more preferred are the silane coupling agents in which the alkyl group has 3 or 4 carbon atoms.

When the silane coupling agents are used, they can be used individually or in a combination thereof. When a plurality of silane coupling agents is used in combination, the silane coupling agents may be used individually or together at the same time for the treatment.

The total amount of the coupling agent used for the treatment is preferably 0.9 part by mass to 3.0 parts by mass with respect to 100 parts by mass of the magnetic bodies, and this amount may be adjusted depending on, for instance, the area of the magnetic bodies and the reactivity of the silane coupling agent.

In the present invention, it is preferable that the toner particle include magnetic bodies.

Further, it is preferable that the proportion of toner particles in which the magnetic bodies are present at at least 65% by area within 10% of the distance between the outline and the center point of the cross section from the outline of the cross section of the toner particle observed by the scanning transmission electron microscope (STEM) be at least 70% by number and not more than 100% by number.

Here, "within 10% of the distance between the outline and the center point of the cross section from the outline of the cross section of the toner particle" is a region obtained in the following manner.

Thus, when the toner particle radius (the distance between the outline and the center point of the cross section from the outline of the cross section of the toner particle) in the cross section of the toner particle obtained by the STEM observation is taken as 1, the distance of 0.1 from the outline of the cross section of the toner particle (that is, 0.9 from the center point of the cross section of the toner particle) is taken as a boundary line. The abovementioned region is from this boundary line to the outline of the cross section of the toner particle (see FIG. 3. The reference numeral 1 denotes a domain of a wax; the reference numeral 2 denotes a domain of a crystalline polyester; the reference numeral 3 denotes a boundary line at 10% of a distance between an outline and a center point of a cross section from the outline of the cross section of a toner; and the reference numeral 4 denotes a magnetic body).

The proportion of the magnetic bodies present in this region is calculated from the ratio of the area of the magnetic bodies present in this region to the area of all of the magnetic bodies present in the cross section of the toner particle by binarizing the image of the cross section of the toner particle.

When 65% by area of the magnetic bodies observed in the cross section of the toner particle are present in the abovementioned region, it indicates that many magnetic bodies are present in the vicinity of the surface layer of the toner particle and that there are few magnetic bodies scattered toward the center of the toner particle.

When the toner particle satisfies the above range, due to the uneven distribution of the magnetic bodies, the magnetic bodies can absorb impacts or vibrations acting upon the toner particles, thereby improving durability.

Figure 4:
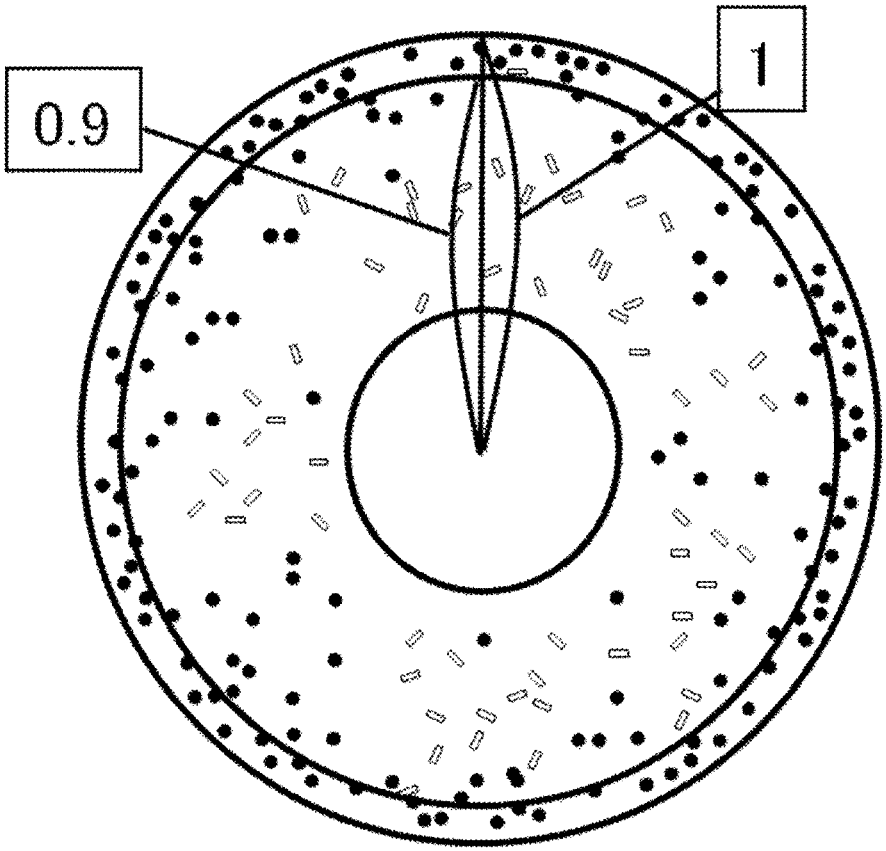
FIG. 4 is an example of a schematic view showing the presence state of domains of magnetic bodies and crystalline polyester.

Meanwhile, when the above range is not satisfied, there is a large number of toner particles in which the magnetic bodies are dispersed not only close to the surface layer but also in the central portion of the toner particle (see FIG. 4), the improvement in durability of the toner particles is small, and the abovementioned effect can be reduced.

From the viewpoint of improving the abovementioned effect, it is more preferable that the proportion of toner particles in which the magnetic bodies are present at at least 75% by area and not more than 100% by area within 10% of the distance between the outline and the center point of the cross section from the outline of the cross section of the toner particle be at least 70% by number and not more than 100% by number. It is more preferable that the proportion of the toner particles in which the magnetic bodies are present at at least 80% by area and not more than 100% by area be at least 70% by number and not more than 100% by number.

Hydrophobic treatment of the surface of the magnetic bodies is an example of a method for unevenly distributing the magnetic bodies in the vicinity of the surface layer of the toner particle. Specifically, it is possible to adjust as appropriate, for instance, the type and treatment amount of the treatment agent used for the hydrophobic treatment of the surface of the magnetic bodies, pH during the treatment, and the treatment method.

Further, it is preferable to use the below-described method for producing the toner because the uneven distribution of the magnetic bodies can be easily controlled.

In the present invention, the toner particle may include a charge control agent in order to keep stable charging performance of the toner regardless of the environment.

Examples of negative-charging charge control agents are presented below.

Monoazo metal compounds, acetylacetone metal compounds, metal compounds of aromatic hydroxycarboxylic acids, aromatic dicarboxylic acids, hydroxycarboxylic acids and dicarboxylic acids, aromatic hydroxycarboxylic acids, aromatic mono- and polycarboxylic acids, metal salt, anhydrides and esters thereof, phenol derivatives such as bisphenol, urea derivative, metal-containing salicylic acid compounds, metal-containing naphthoic acid compounds, boron compounds, quaternary ammonium salts, calixarenes, and resin type charge control agents.

Examples of positive-charging charge control agents are presented below.

Nigrosine-modified compounds formed by nigrosine and fatty acid metal salts; guanidine compounds; imidazole compounds; onium salts, for example, quaternary ammonium salts such as tributylbenzylammonium-1-hydroxy-4-naphthosulfonate and tetrabutylammonium tetrafluoroborate, phosphonium salts which are analogs thereof, and lake pigments thereof; triphenylmethane dyes and lake pigments thereof (examples of the laking agents include phosphotungstic acid, phosphomolybdic acid, phosphotungstenmolybdic acid, tannic acid, lauric acid, gallic acid, ferricyanid, and ferrocyanide); higher fatty acid metal salts, diorganotin oxides such as dibutyltin oxide, dioctyltin oxide, and dicyclohexyltin oxide; diorganotin borates such as dibutyltin borate, dioctyltin borate, and dicyclohexyltin borate; and resin type charge control agents.

These charge control agents can be used individually or in combinations of two or more thereof.

Among them, other than the resin type charge control agents, metal-containing salicylic acid compounds are preferable, such compounds in which the metal is aluminum or zirconium are more preferable, and aluminum salicylate compounds are even more preferable.

Examples of the preferred resin type charge control agents include polymers or copolymers having a sulfonic acid group, a sulfonic acid salt group or a sulfonic acid ester group, a salicylic acid moiety, and a benzoic acid moiety.

The compounded amount of the charge control agent is preferably at least 0.01 part by mass and not more than 20.00 parts by mass, and more preferably at least 0.05 part by mass and not more than 10.00 parts by mass with respect to 100 parts by mass of the binder resin.

In the present invention, toner base particles can be produced by any known method. Incidentally, toner base particles to which an external additive is added are referred to as a toner, but when an external additive is not added, the toner base particles become, as they are, a toner.

First, the case of producing the toner base particles by a pulverization method will be described.

For instance, the binder resin, the colorant, the wax, the crystalline polyester, and, if necessary, the charge control agent are thoroughly mixed with a mixer such as a Henschel mixer or a ball mill. The mixture is thereafter melted and kneaded using a thermal kneader such as a heating roll, a kneader, and an extruder to disperse or dissolve a toner material, and a toner particle is obtained by solidifying by cooling, pulverizing, then classifying, and optionally performing surface treatment. The order of classification and surface treatment may be reversed. In the classification step, it is preferable to use a multi-division classifier to increase production efficiency.

The pulverization can be performed by a method using a known pulverizing apparatus of a mechanical impact type, jet type, or the like. In addition, it is also possible to perform the pulverization by applying heat or by adding mechanical impacts. Further, a hot bath method for dispersing finely pulverized (optionally classified) particles, which are to be treated, in hot water, or a method for passing through a hot air flow may be used.

Examples of means for applying a mechanical impact force include a method using a mechanical impact crusher such as a Kryptron system manufactured by Kawasaki Heavy Industries, Ltd. or a turbo mill manufactured by Turbo Kogyo Co., Ltd. Devices such as a mechanofusion system manufactured by Hosokawa Micron Corporation and a hybridization system manufactured by Nara Machinery Co., Ltd. can also be used. In these devices, the particles to be treated are pressed against the inside of a casing by a centrifugal force created by vanes rotating at a high speed, and a mechanical impact force is applied to the particles by a force such as a compression force and a friction force.

In the present invention, the toner base particles can be produced by the pulverization method such as described hereinabove, but from the standpoint of controlling the presence state of the crystalline substance such as the crystalline polyester and wax, the toner base particles are preferably produced in an aqueous medium. In particular, a suspension polymerization method is preferred because this method enables control that ensures the fine dispersion state of the crystalline polyester and promotes crystallization.

The suspension polymerization method will be described hereinbelow in detail, but this description is not limiting.

A method for producing toner base particles by using the suspension polymerization method includes:

a step of dispersing a polymerizable monomer composition including a polymerizable monomer constituting the binder resin, a colorant, a wax and a crystalline polyester, and, if necessary, a polymerization initiator, a crosslinking agent, a charge control agent, and other additives in a continuous layer (for example, an aqueous medium) including a dispersing agent by using a suitable stirrer, and forming particles of the polymerizable monomer composition in the aqueous medium, and a step of polymerizing the polymerizable monomer contained in the particles of the polymerizable monomer composition.

The stirring intensity of the stirrer may be selected with consideration for material dispersibility, productivity, and the like. In the step of polymerizing the polymerizable monomer, the polymerization temperature may be set to a temperature of at least 40° C., generally at least 50° C. and not more than 90° C. When the polymerization is performed in this temperature range, the wax to be sealed inside is precipitated by phase separation, and the wax can be encapsulated more satisfactorily.

In the present invention, when the toner base particle includes magnetic bodies, a method for producing the toner base particles may include:

a step of dispersing at least magnetic bodies in the polymerizable monomer constituting the binder resin to obtain a magnetic body-containing polymerizable monomer (magnetic body dispersion step);

a step of preparing a polymerizable monomer composition by mixing the obtained magnetic body-containing polymerizable monomer, wax and crystalline polyester (polymerizable monomer composition preparation step);

a step of dispersing the obtained polymerizable monomer composition in an aqueous medium to form particles of the polymerizable monomer composition (granulation step); and a step of polymerizing the polymerizable monomer contained in the particles of the polymerizable monomer composition (polymerization step).

Here, in the magnetic body dispersion step, it is preferable to disperse the magnetic bodies in the polymerizable monomer by using a stirring device (see FIGS. 5 and 6) in which a rotor in which ring-shaped protrusions provided with a plurality of slits are formed concentrically in multiple stages and a stator having projections of the same shape are installed coaxially so as to mesh with each other while maintaining a constant interval therebetween.

Further, in the polymerizable monomer composition preparation step, it is preferable to mix the magnetic body-containing polymerizable monomer, wax and crystalline polyester by using the abovementioned stirring device.

Figure 5A:
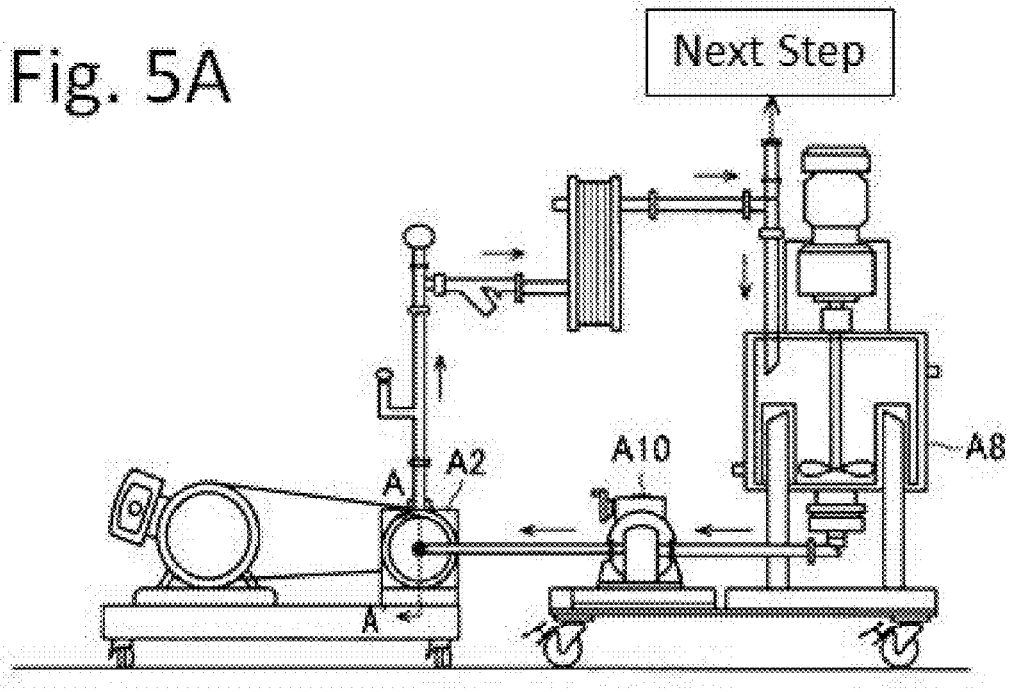
FIG. 5A is a system diagram in which a stirring device is incorporated in a circulation path.
Figure 5B:
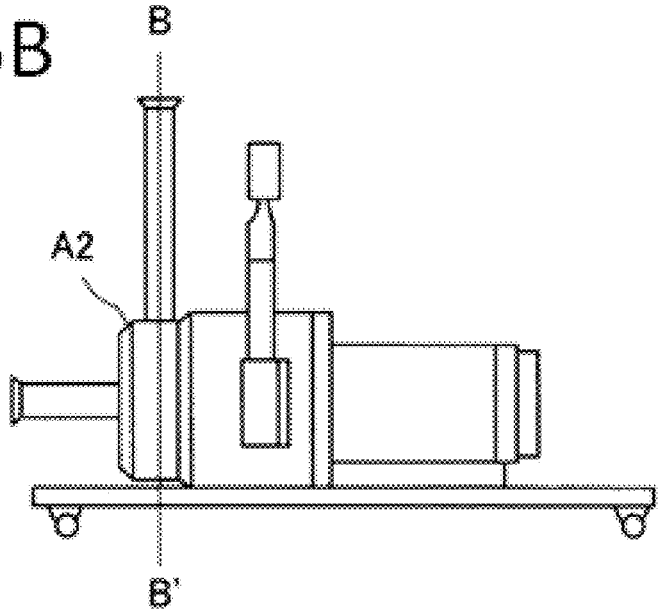
FIG. 5B is a side view of the main body of the stirring device.

FIG. 5A shows a system in which the stirring device is incorporated in a circulation path, and FIG. 5B is a side view of the main body of the stirring device. However, the stirring device used in the present invention is not limited to this system. FIGS. 6A and 6B are cross-sectional views of the main body of the stirring device and are, respectively, a cross-sectional view taken along line A-A' in FIG. 5A and a cross-sectional view taken along line B-B' in FIG. 5B. FIGS. 6C and 6D are a perspective view of the rotor and a perspective view of the stator, respectively, of the stirring device. The stirring device will be described hereinbelow in detail.

In FIG. 5A, a polymerizable monomer and at least magnetic bodies are loaded into a holding tank A8 to obtain a preparation liquid. The loaded preparation liquid is supplied from the inlet of the mixing apparatus through a circulation pump A10, passes through the slits of a rotor A25 and a stator A22 provided inside a casing A2 in the stirring apparatus, and is discharged in the centrifugal direction. When the preparation liquid passes through the inside of the stirring device, the preparation liquid is mixed and dispersed by the compression in the centrifugal direction caused by the displacement of the slits of the rotor and the stator, the impact caused by the discharge, and the impact caused by shearing between the rotor and the stator, and a magnetic body-containing polymerizable monomer is obtained (magnetic body dispersion step). Further, the wax and crystalline polyester are loaded into the magnetic body-containing polymerizable monomer in the holding tank A8 and mixed and dispersed in the same manner by circulation between the stirring device and the holding tank A8, and a polymerizable monomer composition is obtained (polymerizable monomer composition preparation step).

The shape of the rotor and the stator is preferably such that ring-shaped protrusions provided with a plurality of slits are formed concentrically in multiple stages and the rotor and the stator are installed coaxially so as to mesh with each other while maintaining a constant interval therebetween. Because of a shape in which the rotor and the stator are installed so as to be meshed with each other, a short path is reduced and the preparation liquid can be sufficiently dispersed. Further, since the rotor and the stator are alternately present in multiple stages in concentric circle directions, the preparation liquid is subjected to a large number of shears and impacts when advancing in the centrifugal direction. As a result, the level of dispersing can be further increased. Since the holding tank A8 has a jacket structure, the treatment object can be cooled and heated.

The peripheral speed of the rotor and the stator is the peripheral speed of the maximum diameter of the rotor and the stator. In the present invention, when the peripheral speed of the rotor A25 is denoted by G (m/s), it is preferable to stir the preparation liquid by rotating the preparation liquid at $20 \leq G \leq 60$. More preferably, the peripheral speed G of the rotor is $30 \leq G \leq 40$. Where the peripheral speed G of the rotor is $20 \leq G \leq 60$, the impacts caused by compression and discharge of the preparation liquid in the centrifugal direction caused by the displacement of the slits of the rotor and the stator, and the impacts caused by shearing between the rotor and the stator are increased, and a high level of dispersion is achieved. As a result, the unevenness in dispersion of the preparation liquid is much smaller than in the conventional processes, and it is possible to reach a uniform dispersion state.

When the stirring device is used, it is easy to control so that the above-described large number of magnetic bodies are present in the vicinity of the surface layer of the toner particle.

Cavitron (manufactured by Eurotec Co., Ltd.) is a specific example of the above-described stirring device.

In addition to the abovementioned stirring device, a stirring device provided with stirring blades having a high shearing force, which is generally used for emulsification/dispersion, may be used. Cleamix Disolver (manufactured by M Technique Co., Ltd.) and DISPER (manufactured by Tajima-KK) are specific examples of stirring blades having a high shearing force.

Examples of the polymerizable monomer are presented below.

Styrene monomers such as styrene, o-methylstyrene, m-methylstyrene, p-methylstyrene, p-methoxystyrene, and p-ethylstyrene; acrylic acid esters such as methyl acrylate, ethyl acrylate, n-propyl acrylate, n-butyl acrylate, isobutyl acrylate, tert-butyl acrylate, n-hexyl acrylate, n-octyl acrylate, dodecyl acrylate, 2-ethylhexyl acrylate, stearyl acrylate, 2-chloroethyl acrylate, phenyl acrylate, and cyclohexyl acrylate; methacrylic acid esters such as methyl methacrylate, ethyl methacrylate, n-propyl methacrylate, n-butyl methacrylate, isobutyl methacrylate, tert-butyl methacrylate, n-hexyl methacrylate, n-octyl methacrylate, dodecyl methacrylate, 2-ethylhexyl methacrylate, stearyl methacrylate, phenyl methacrylate, dimethylaminoethyl methacrylate, diethylaminoethyl methacrylate, and cyclohexyl methacrylate; and other monomers such as acrylonitriles, methacrylonitriles, and acrylamides.

These monomers can be used individually or in a mixture thereof.

Among the above-described polymerizable monomers, the advantageous examples include styrene monomers, acrylic acid ester monomers, and methacrylic ester monomers.

Further, the content of the styrene monomer in the polymerizable monomer is preferably at least 60% by mass and not more than 90% by mass, and more preferably at least 65% by mass and not more than 85% by mass. Meanwhile, the total content of the acrylic acid ester monomer and methacrylic acid ester monomer is preferably at least 10% by mass and not more than 40% by mass, and more preferably at least 15% by mass and not more than 35% by mass.

The polymerization initiator is preferably one having a half-life of 0.5 h to 30 h during the polymerization reaction. Further, where the polymerization reaction is carried out using an addition amount of 0.5 parts by mass to 20 parts by mass with respect to 100 parts by mass of the polymerizable monomer, a polymer having a maximum between the molecular weight of 5,000 and 50,000 can be obtained and the desired strength and suitable melting characteristics can be imparted to the toner.

Specific examples of the polymerization initiator include azo type or diazo type polymerization initiators such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4-dimethylvaleronitrile, and azobisisobutyronitrile, and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, t-butylperoxy 2-ethylhexanoate, and t-butyl peroxypivalate.

As mentioned above, the addition of the crosslinking agent is optional. The addition amount thereof is preferably 0.001 part by mass to 15 parts by mass with respect to 100 parts by mass of the polymerizable monomer.

Mainly compounds having at least two polymerizable double bonds are preferably used as the crosslinking agent.

Specific examples thereof include aromatic divinyl compounds such as divinylbenzene and divinylnaphthalene; carboxylic acid esters having two double bonds, such as compounds represented by the following formula (IV), triethylene glycol diacrylate, tetraethylene glycol diacrylate, polyethylene glycol diacrylate, neopentyl glycol diacrylate, tripropylene glycol diacrylate, and polypropylene glycol diacrylate; divinyl compounds such as divinylaniline, divinyl ether, divinylsulfide, and divinylsulfone; and compounds having at least three vinyl groups. These compounds may be used individually or in combinations of two or more thereof.

Among them, compounds represented by the following formula (IV) are preferred.

式 (IV)

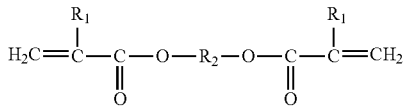

(in formula (IV), $R_1$ represents a hydrogen atom or an alkyl group having 1 to 3 carbon atoms (preferably, a methyl group), $R_2$ represents a straight chain alkylene group having 2 to 18 carbon atoms (preferably, 4 to 18 carbon atoms).

Specific examples of the compound represented by formula (IV) include ethylene glycol diacrylate, 1,3-butanediol diacrylate, 1,4-butanediol diacrylate, 1,5-pentanediol diacrylate, 1,6-hexanediol diacrylate, 1,7-heptanediol diacrylate, 1,8-octanediol diacrylate, 1,9-nonanediol diacrylate, 1,10-decanediol diacrylate, 1,11-undecanediol diacrylate, and 1,18-octadecanediol diacrylate, and compounds in which the acrylate is replaced with methacrylate.

Since the compound represented by the above formula (IV) has flexibility and the molecular chain thereof is relatively long, the interval between the crosslinking points of the binder resin is likely to be wide and a large network structure is likely to be formed.

As a result, by using the compound represented by formula (IV), it is possible to control G'(t)/G'(120) within the range defined by the present invention and to suppress the occurrence of the trailing end offset.

Although the reason for this is not clear, it can be presumed that this is possible because the viscoelastic behavior of the toner can be easily controlled by creating a crosslinked structure, and at the same time, since the interval between the crosslinking points is wide, deformation of the resin at the time of fixing is likely to be advanced and the crosslinked structure is unlikely to impair the fixing performance.

As the dispersing agent, known dispersing agents can be used. Examples of inorganic dispersing agents include calcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of organic dispersing agents include polyvinyl alcohol, gelatin, methyl cellulose, methyl hydroxypropyl cellulose, ethyl cellulose, sodium salt of carboxymethyl cellulose, polyacrylic acid and salts thereof, and starch which are used by dispersing in an aqueous phase.

These may be used individually or in combinations of a plurality thereof.

The concentration of the dispersing agent is preferably at least 0.2 parts by mass and not more than 20.0 parts by mass with respect to 100 parts by mass of the polymerizable monomer composition. A surfactant may be used in combination with the dispersant. The concentration of the surfactant is preferably at least 0.001 parts by mass and not more than 0.1 parts by mass with respect to 100 parts by mass of the polymerizable monomer composition.

Examples of the surfactant include sodium dodecylbenzene sulfate, sodium tetradecyl sulfate, sodium pentadecyl sulfate, sodium octyl sulfate, sodium oleate, sodium laurate, sodium stearate, and potassium stearate.

In the present invention, the presence state of the crystalline polyester domains and wax domain in the cross section of the toner particle can be easily controlled within the above-described ranges by using the method described below.

For example, after polymerizing the polymerizable monomer to obtain resin particles, a dispersion obtained by dispersing the resin particles in an aqueous medium is heated to a temperature exceeding the melting points of the crystalline polyester and wax. However, when the polymerization temperature exceeds the melting point, this operation is not necessary.

In the present invention, attention is directed to a method for producing a toner with the object of crystallizing crystalline materials such as the crystalline polyester and wax, particularly the crystalline polyester.

For example, when a toner is produced by a pulverization method, suspension polymerization, or emulsion polymerization, the production method often includes a step of raising the temperature to a level such that the crystalline polyester or wax are melted and then cooling to room temperature.

Considering the cooling step, the molecular motion of the crystalline polyester liquefied by heating is slowed down as the temperature decreases, and crystallization starts when the temperature reaches the vicinity of the crystallization temperature. Further cooling advances the crystallization, and complete solidification takes place at normal temperature. According to the investigation conducted by the inventors of the present invention, the degree of crystallinity of the crystalline substance differs depending on the cooling rate.

Specifically, when the crystalline polyester or wax is cooled at a high cooling rate from a sufficiently high temperature (for example, 100° C.) at which the crystalline polyester or wax melts to the vicinity of the crystallization temperature of the crystalline substance, the degree of crystallinity of the contained crystalline substance tends to increase. Further, ensuring a sufficiently high cooling rate facilitates control of the aforementioned small domains to the preferred range of the present invention.

Meanwhile, where the cooling rate is low, the degree of crystallinity of the crystalline polyester and wax is likely to decrease in the course of gradual cooling, and they are likely to be compatible with the binder resin.

In this case, small domains of the crystalline polyester are unlikely to be formed, and it tends to be difficult for the wax to form a large domain of a larger size.

As a result, the binder resin is likely to soften, making it difficult to suppress the occurrence of fogging after the toner has been allowed to stand under a high-temperature severe environment, and it also becomes difficult to suppress the occurrence of the trailing end offset.

More specifically, a state in which the cooling rate is sufficiently high refers to a case of cooling at a cooling rate of at least 50.0° C./min, and particularly when the objective is to crystallize the crystalline polyester, the cooling rate is preferably at least 100.0° C./min, and more preferably at least 150.0° C./min.

By contrast, a state in which the cooling rate is sufficiently low refers to a case of cooling at a rate sufficiently lower than 10.0° C./min, for example, at at least 0.5° C./min and not more than 5.0° C./min, or at a lower cooling rate.

Further, it is preferable to perform annealing treatment in the vicinity of the crystallization temperature of the crystalline substance (more specifically, in the range of crystallization temperature ±5° C.) from the viewpoint of increasing the degree of crystallinity of the crystalline substance.

The holding time is preferably at least 30 min, more preferably at least 60 min, and even more preferably a least 100 min. The upper limit of the holding time is not more than about 24 h from the viewpoint of production efficiency.

It is preferable to hold for a long period of time because the degree of crystallinity of the crystalline substance can be easily increased.

Toner base particles can be obtained by filtering, washing and drying the obtained resin particles by known methods. The toner of the present invention can be obtained by mixing, if necessary, the toner base particles with the below-described inorganic fine particles and causing the inorganic fine particles to adhere to the surface of the toner base particles. It is also possible to introduce a classification step into the production process (before mixing the inorganic fine particles) and cut coarse powder or fine powder contained in the toner base particles.

Regarding the mixing method, a known method can be used. For example, a Henschel mixer or the like is preferably used. The number average particle diameter of the primary particles of the inorganic fine particles is preferably from 4 nm to 80 nm, and more preferably from 6 nm to 40 nm.

The inorganic fine particles are added for improving the flowability of the toner and charging uniformity of the toner particles, but it is also preferable to impart a function of adjusting the charge quantity of the toner and improving the environmental stability by processing the inorganic fine particles for example by hydrophobic treatment.

Examples of the inorganic fine particles include silica fine particles, titanium oxide fine particles, and alumina fine particles. As the silica fine particles, for example, both the so-called dry silica produced by vapor phase oxidation of silicon halides, fumed silica, and the so-called wet silica produced from water glass can be used. However, the dry silica with few silanol groups present on the surface or inside the silica fine particles and also few production residues such as $Na_2O$ and $SO_3^{2-}$ is more preferable. Further, the dry silica is also inclusive of composite fine particles of silica and other metal oxides that can be obtained by using other metal halides such as aluminum chloride and titanium chloride together with a silicon halide in the producing process.

The amount added of the inorganic fine particles is preferably at least 0.1 part by mass and not more than 3.0 parts by mass with respect to 100 parts by mass of the toner base particles.

The inorganic fine particles are preferably subjected to hydrophobic treatment with a treatment agent such as silicone varnish, various modifications thereof, silicone oil, various modifications thereof, silane compounds, silane coupling agents, other organosilicon compounds, or organotitanium compounds.

The toner of the present invention may further include small amounts of other additives such as lubricant powder such as fluororesin powder, zinc stearate powder, and polyvinylidene fluoride powder; a polishing agent such as cerium oxide powder, silicon carbide powder and strontium titanate powder; and an anti-caking agent, within ranges in which substantially no adverse effect is produced. These additives can be also used after subjecting the surface thereof to hydrophobic treatment.

In the present invention, the weight average particle diameter (D4) of the toner is preferably at least 4.0 μm and not more than 11.0 μm, and more preferably at least 5.0 μm and not more than 10.0 μm.

When the weight average particle diameter (D4) of the toner is adjusted to the abovementioned range, the flowability is further improved and the latent image can be faithfully developed.

An example of an image forming apparatus used in the present invention will be specifically described with reference to FIG. 1. In FIG. 1, the reference numeral 100 denotes an electrostatic latent image bearing member (also referred to hereinbelow as a photosensitive member), around which a charging member (charging roller) 117, a developing unit 140 having a toner carrying member 102, a developing blade 103 and a stirring member 141, a transfer member (transfer charging roller) 114, a cleaner container 116, a fixing device 126, a pickup roller 124, a transport belt 125 and the like are provided. The photosensitive member 100 is charged by the charging roller 117 to, for example, −600 V (the applied voltage is, for example, an AC voltage of 1.85 kVpp, a DC voltage of −620 Vdc). Exposure is then performed by irradiating the photosensitive member 100 with a laser beam 123 by a laser generator 121, and an electrostatic latent image corresponding to the target image is formed. The electrostatic latent image on the photosensitive member 100 is developed with one-component toner by the developing unit 140 to obtain a toner image, and the toner image is transferred onto a transfer material by a transfer charging roller 114 that has been brought into contact with the photosensitive member, with the transfer material being interposed therebetween. The transfer material on which the toner image is placed is conveyed by the transport belt 125 and the like to the fixing device 126 and the image is fixed to the transfer material. Further, a part of the toner remaining on the photosensitive member is cleaned by the cleaner container 116.

Although an image forming apparatus for magnetic one-component jumping development is shown herein, an apparatus suitable for either jumping development or contact development method may be used.

Hereinafter, methods for measuring physical properties of the toner of the present invention will be described hereinbelow.

<Measurement of Viscoelasticity of Toner>

As a measuring apparatus, a rotating flat plate rheometer (trade name "ARES", manufactured by TA Instruments.) is used.

Sample preparation and measurements are performed under the following conditions.

Measuring Jig: Torsion Recuperator Fixture

Measurement sample: a toner set at 25° C. and dried for at least 10 h in a vacuum dryer is used.

Sample shape: long side 30.0 mm, short side 12.5 mm, thickness 2.5 mm to 3.5 mm. However, the thickness uniformity is set to ±0.05 mm.

Sample molding conditions: sample molding is performed at a temperature of 25° C., a pressure of 50 MPa and a pressing time of 60 min by using a tablet shaper.

Angular vibration frequency: 6.28 rad/s, the measurement temperature range is set from 25° C. to 180° C., and the heating rate in this range is set to 4.0° C./min.

Initial value of applied strain: 0.01%, and measurement is performed in an automatic strain adjustment mode.

The conditions of the automatic strain adjustment mode (AUTO Strain Mode) are described below.

Max Applied Strain is set to 1.5%.

Max Allowed Torque is set to 180.0 g·cm.

Min Allowed Torque is set to 0.4966 g·cm.

Strain Adjustment is set to 20.0% of Current Strain.

Measurements are performed in automatic tension adjustment mode (AUTO Tension Mode).

The conditions of the automatic tension adjustment mode (AUTO Tension Mode) are described below.

Automatic tension direction (AUTO Tension Direction) is set as tension (Tension).

Initial Static Force is set to 10.0 g.

AUTO Tension Sensitivity is set to 40.0 g.

Sample Modulus is set to $<1.0\times10^8$ (Pa).

<Measurement of Melting Points of Crystalline Polyester and Wax>

The melting points of the crystalline polyester and wax can be obtained as the peak temperature of the maximum endothermic peak when measured using a differential scanning calorimeter.

The crystalline polyester and the wax are isolated, as necessary, from the toner by the above-described method. The measurements are carried out according to ASTM D 3418-82 using a differential scanning calorimeter "Q1000" (manufactured by TA Instruments.).

The melting points of indium and zinc are used for temperature correction of the detection unit of the apparatus, and heat of melting of indium is used for correction of the calorific value.

Specifically, 1 mg of the sample is accurately weighed and placed in an aluminum pan, an empty aluminum pan is used as a reference, and the measurement is performed in the measurement range from 20° C. to 140° C. with the following setting.

Temperature increase and decrease rate 10° C./min.

After raising the temperature from 20° C. to 140° C., the temperature is lowered from 140° C. to 20° C. Then, the temperature is raised again from 20° C. to 140° C.

In this reheating process, a specific heat change is obtained in the temperature range from 20° C. to 140° C. The melting point Tm (° C.) is the peak temperature of the maximum endothermic peak in the specific heat change curve.

<Measurement of Weight Average Particle Diameter (D4) and Number Average Particle Diameter (D1) of Toner (Base Particles)>

The weight average particle diameter (D4) and the number average particle diameter (D1) of the toner (base particles) are calculated as follows.

A precision particle size distribution measuring apparatus "Coulter Counter Multisizer 3" (registered trademark, manufactured by Beckman Coulter, Inc.) base on a pore electrical resistance method and equipped with a 100 μm aperture tube is used as a measuring apparatus. The dedicated software "Beckman Coulter Multisizer 3 Version 3.51" (manufactured by Beckman Coulter, Inc.) provided with the apparatus is used to set measurement conditions and analyze measurement data. The number of effective measurement channels is 25,000.

An electrolytic aqueous solution used for the measurement is prepared by dissolving special grade sodium chloride in ion exchanged water to a concentration of about 1% by mass. For example, "ISOTON II" (manufactured by Beckman Coulter, Inc.) can be used.

The dedicated software is set as follows before the measurements and analysis.

On the "Change Standard Measurement Method (SOM)" screen of the dedicated software, the total count number of the control mode is set to 50,000 particles, one measurement cycle is performed, and a value obtained by using "Standard Particle 10.0 μm" (manufactured by Beckman Coulter, Inc.) is set as a Kd value. The threshold and the noise level are automatically set by pressing the "Threshold/Noise Level Measurement Button". Further, the current is set to 1600 μA, the gain is set to 2, the electrolytic solution is set to ISOTON II, and "Flush Aperture Tube After Measurement" is checked.

On the "Conversion Setting From Pulse to Particle Diameter" screen of the dedicated software, the bin interval is set to a logarithmic particle diameter, the particle diameter bin is set to 256 particle diameter bins, and the particle diameter range is set to at least 2 μm and not more than 60 μm.

Specific measurement methods are described below.

(1) Approximately 200 mL of the electrolytic aqueous solution is placed in a 250-mL round-bottom glass beaker specifically designed for Multisizer 3, the beaker is set in the sample stand, and stirring with a stirrer rod is performed counterclockwise at 24 rpm. Dirt and air bubbles in the aperture tube are removed by the "FLASH OF APERTURE" function of the dedicated software.

(2) Approximately 30 mL of the electrolytic aqueous solution is placed in a glass 100-mL flat-bottom beaker. A diluted solution, about 0.3 mL, prepared by diluting "Contaminon N" (10% by weight aqueous solution of a neutral detergent of pH 7 for washing precision measuring instruments composed of a nonionic surfactant, an anionic surfactant, and an organic builder, manufactured by Wako Pure Chemical Industries, Ltd.) by a factor of 3 with ion exchanged water was added to the electrolytic aqueous solution.

(3) Two oscillators with an oscillation frequency of 50 kHz are incorporated with a phase shift of 180 degrees, and an ultrasonic disperser "Ultrasonic Dispersion System Tetora 150" (manufactured by Nikkaki Bios Co., Ltd.) with an electrical output of 120 W is prepared. About 3.3 L of ion exchanged water is placed in a water tank of the ultrasonic disperser, and about 2 mL of Contaminon N is added into the water tank.

(4) The beaker of (2) is set in a beaker fixing hole of the ultrasonic disperser, and the ultrasonic disperser is actuated. Then, the height position of the beaker is adjusted so that the resonance state of the liquid surface of the electrolytic aqueous solution in the beaker is maximized.

(5) Approximately 10 mg of the toner (base particles) is added little by little to the electrolytic aqueous solution and dispersed while irradiating the electrolytic aqueous solution in the beaker of (4) with ultrasonic waves. Then, the ultrasonic dispersion process is further continued for 60 seconds. During the ultrasonic dispersion the water temperature in the water tank is adjusted as appropriate to at least 10° C. and not more than 40° C.

(6) The electrolytic aqueous solution of (5) in which the toner (particles) have been dispersed is dropwise added using a pipette to the round-bottom beaker of (1) which has been placed in the sample stand, and the measurement concentration is adjusted to about 5%. Then, measurement is performed until the number of particles to be measured reaches 50,000.

(7) The measurement data are analyzed with the dedicated software provided with the apparatus to calculate the weight average particle diameter (D4) and the number average particle diameter (D1). The "Average Diameter" on the "Analysis/Volume Statistical Value (Arithmetic Average)" screen when set as graph/% by volume with the dedicated software is the weight average particle diameter (D4), and the "Average Diameter" on the "Analysis/Number Statistical Value (Arithmetic Average)" screen when set as graph/% by volume with the dedicated software is the number average particle diameter (D1).

<Measurement of Molecular Weight Distribution of Crystalline Polyester>

The molecular weight distribution (weight average molecular weight Mw, number average molecular weight Mn and peak molecular weight) of the crystalline polyester is measured in the following manner by using gel permeation chromatography (GPC).

First, the sample is dissolved in tetrahydrofuran (THF) at room temperature. Then, the obtained solution is filtered through a solvent resistant membrane filter "Mae Shori Disk" (manufactured by Tosoh Corporation) having a pore diameter of 0.2 μm to obtain a sample solution. The sample solution is adjusted so that the concentration of the component soluble in THF is 0.8% by mass. Measurements are performed under the following conditions by using this sample solution.

Apparatus: high-speed GPC apparatus "HLC-8220 GPC" (Detector: RI) (manufactured by Tosoh Corporation).

Column: 2 sets of SHODEX GPC LF-604 (Showa Denko KK)

Eluent: THF

Flow rate: 0.6 mL/min

Oven temperature: 40° C.

Sample injection amount: 0.020 mL

When the molecular weight of the sample is calculated, a molecular weight calibration curve is used which is prepared using a standard polystyrene resin (trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corporation).

<Measurement of Acid Value>

The acid value is the number of milligrams of potassium hydroxide necessary to neutralize the acid contained in 1 g of the sample. The acid value in the present invention is measured according to JIS K 0070-1992, specifically, it is measured according to the following procedure.

(1) Preparation of Reagent

A total of 1.0 g of phenolphthalein is dissolved in 90 mL of ethyl alcohol (95% by volume), ion exchanged water is added to make 100 mL, and a phenolphthalein solution is obtained.

A total of 7 g of special grade potassium hydroxide is dissolved in 5 mL of water, and ethyl alcohol (95% by volume) is added to 1 L. The solution is poured in an alkali-resistant container and allowed to stand for 3 days without contact with carbon dioxide, or the like, and then filtered to obtain a potassium hydroxide solution. The obtained potassium hydroxide solution is stored in the alkali-resistant container. A total of 25 mL of 0.1 mol/L hydrochloric acid is taken into an Erlenmeyer flask, a few drops of phenolphthalein solution are added, titration with potassium hydroxide solution is performed, and a factor of potassium hydroxide solution is determined from the amount of the potassium hydroxide solution required for neutralization. The 0.1 mol/L hydrochloric acid is prepared according to JIS K 8001-1998.

(2) Operation (A) Main Test

A total of 2.0 g of the crushed sample is accurately weighed into a 200 mL Erlenmeyer flask, 100 mL of a mixed solution of toluene: ethanol (2:1) is added, and dissolution is performed over 5 hs. Then, a few drops of phenolphthalein solution as an indicator are added and titration is performed with a potassium hydroxide solution. The end point of the titration is when the light crimson color of the indicator lasts about 30 sec.

(B) Blank Test

The titration is performed in the same manner as in the abovementioned operation except that no sample is used (that is, only a mixed solution of toluene: ethanol (2:1) is used).

(3) The obtained value is substituted into the following formula to calculate the acid value.

$$A=[(C-B)\times f\times 5.61]/S$$

Here, A: acid value (mg KOH/g), B: amount (mL) added of potassium hydroxide solution in the blank test, C: amount (mL) added of potassium hydroxide solution in the main test, f: factor of potassium hydroxide solution, S: sample (g).

<Measurement of Hydroxyl Value>

The hydroxyl value is the number of milligrams of potassium hydroxide required to neutralize acetic acid bonded to hydroxyl groups when 1 g of a sample is acetylated. The hydroxyl value in the present invention is measured according to JIS K 0070-1992, specifically, it is measured according to the following procedure.

(1) Preparation of Reagent

A total of 25 g of special grade acetic anhydride is placed in a 100 mL measuring flask, pyridine is added to make the total volume 100 mL, and an acetylation reagent is obtained by sufficient shaking. The obtained acetylation reagent is stored in a brown bottle so as to prevent contact with moisture, carbon dioxide, etc.

A total of 1.0 g of phenolphthalein is dissolved in 90 mL of ethyl alcohol (95% by volume), and ion exchanged water is added to make it 100 mL and obtain a phenolphthalein solution. A total of 35 g of special grade potassium hydroxide is dissolved in 20 mL of water and ethyl alcohol (95 vol %) is added to make 1 L. The solution is poured in an alkali-resistant container and allowed to stand for 3 days without contact with carbon dioxide, or the like, and then filtered to obtain a potassium hydroxide solution. The obtained potassium hydroxide solution is stored in the alkali-resistant container. A total of 25 mL of 0.5 mol/L hydrochloric acid is taken into an Erlenmeyer flask, a few drops of phenolphthalein solution are added, titration with potassium hydroxide solution is performed, and a factor of potassium hydroxide solution is determined from the amount of the potassium hydroxide solution required for neutralization.

(2) Operation (A) Main Test

A total of 1.0 g of the crushed sample is accurately weighed in a 200 mL round-bottom flask, and 5.0 mL of the acetylation reagent is accurately added to the sample by using a hole pipette. In this case, when the sample is difficult to dissolve in the acetylation reagent, a small amount of special grade toluene is added to enhance the dissolution.

A small funnel is placed in the mouth of the flask and heating is performed by immersing the bottom of the flask to about 1 cm in a glycerin bath at about 97° C. At this time, in order to prevent the temperature of the neck of the flask from rising due to the heat of the bath, it is preferable to cover the neck of the flask with cardboard with round holes.

After 1 h, the flask is removed from the glycerin bath and allowed to cool. After cooling, 1 mL of water is added from the funnel, and the funnel is shaken to hydrolyze acetic anhydride. For even more complete hydrolysis, the flask is again heated in the glycerin bath for 10 min. The funnel and flask are allowed to cool and walls thereof are then washed with 5 mL of ethyl alcohol.

A few drops of phenolphthalein solution as an indicator are added and titration is performed with a potassium hydroxide solution. The end point of the titration is when the light crimson color of the indicator lasts about 30 sec.

(B) Blank Test

The titration is performed in the same manner as in the abovementioned operation except that no sample is used.

(3) The obtained result is substituted into the following formula to calculate the hydroxyl value.

$$A=[\{(B-C)\times 28.05\times f\}/S]+D$$

Here, A: hydroxyl value (mg KOH/g), B: amount (mL) added of potassium hydroxide solution in the blank test, C: amount (mL) added of potassium hydroxide solution in the main test, f: factor of potassium hydroxide solution, S: sample (g), and D: acid value (mg KOH/g) of the sample.

<Observation of Cross Section of Toner Particle under Scanning Transmission Electron Microscope (STEM)>

The cross section of the toner particle observed under a scanning transmission electron microscope (STEM) is prepared as follows.

When the toner particle is stained with ruthenium, the crystalline resin contained in the toner particle has a high contrast and can be easily observed. In the case of using ruthenium staining, the amount of ruthenium atoms varies depending on the intensity of staining. Therefore, a strongly stained portion has many ruthenium atoms, the electron beam does not penetrate therethrough, and the portion becomes black on the observation image. A weakly stained portion easily transmits the electron beam and turns white on the observation image.

Specifically, the crystalline polyester is stained weaker than other organic components constituting the toner particle. This is probably because penetration of the staining material into the crystalline polyester is weaker than into other organic components constituting the toner particle due to a difference in density and the like.

Ruthenium which has not penetrated into the crystalline polyester tends to remain at the interface between the crystalline polyester and the amorphous resin, and the crystalline polyester is observed to be black, for example, when the crystals are acicular. Meanwhile, the wax is observed to be the whitest because ruthenium penetration is suppressed more.

A procedure for preparing the cross section of a ruthenium-stained toner particle will be described hereinbelow.

First, toner is scattered as a single layer on a cover glass (Matsunami Glass Ind., Ltd., Angular Cover Glass; Square No. 1), and an Os film (5 nm) and a naphthalene film (20 nm) are formed as protective films by using an osmium—plasma coater (Filgen, Inc., OPC80T).

Next, a photocurable resin D800 (JEOL Ltd.) is filled in a PTFE tube (φ1.5 mm×φ3 mm×3 mm), and the cover glass is quietly placed on the tube in a direction such that the toner comes into contact with the photocurable resin D800. In this state, the resin is cured by light irradiation, and then the cover glass and the tube are removed to form a columnar resin in which the toner is embedded in the outermost surface.

The cross section of the toner particle is obtained by cutting through a length equal to the radius of the toner particle (for example, 4.0 μm when the weight average particle diameter (D4) is 8.0 μm) from the outermost surface of the columnar resin at a cutting speed of 0.6 mm/s with an ultrasonic ultramicrotome (Leica Microsystems GmbH, UC7).

Next, cutting is performed to have a film thickness of 250 nm, and a thin sample of the cross section of the toner particle is produced. By cutting in this way, it is possible to obtain a cross section of the central part of the toner particle.

The obtained thin sample is stained for 15 min in a $RuO_4$ gas atmosphere at 500 Pa by using a vacuum electron staining apparatus (Filgen, Inc., VSC 4 R1H), and a STEM image is prepared using the scanning image mode of a scanning transmission electron microscope (JEOL Ltd., JEM 2800).

An image is acquired with a STEM probe size of 1 nm and an image size of 1024×1024 pixels. Also, an image is acquired by adjusting Contrast of the Detector Control panel of the bright field image to 1425, Brightness to 3750, Contrast of the Image Control panel to 0.0, Brightness to 0.5, and Gamma to 1.00.

For the obtained STEM image, binarization (threshold 120/255 steps) is performed with image processing software "Image-Pro Plus" (manufactured by Media Cybernetics, Inc.).

When the binarization threshold is set to 120, a portion surrounded by a black boundary line is the crystalline polyester, and a portion that looks white when the binarization threshold is set to 210 is wax.

<Identification of Crystalline Polyester and Wax Domains>

The domains of the crystalline polyester and wax are identified by the following procedure on the basis of the STEM image.

When crystalline polyester and wax can be obtained as raw materials, their crystal structures are observed in the same manner as in the above-described observation method using ruthenium staining and a scanning transmission electron microscope (STEM), and images of the lamellar structure of the crystals of each raw material are obtained. The images are compared with the lamellar structure of the domains in the cross section of the toner, and when the error of the layer spacing of the lamellae is not more than 10%, it is possible to identify the raw material forming the domains in the cross section of the toner.

Where raw materials of crystalline polyester and wax cannot be obtained, the operation of isolation from the toner may be performed as described hereinabove.

<Measurement of Number Average Long Diameter of Domains of Crystalline Polyester and Maximum Diameter of Domain of Wax>

The number average long diameter of the domains of the crystalline polyester means a number average diameter determined from long diameters of the domains of the crystalline polyester on the basis of the STEM image.

In the present invention, the long diameter of the domain of the crystalline polyester and the maximum diameter of the domain of the wax use the longest diameter of these domains. When the domain is of an indefinite form, a method for measuring the longest dimension is adopted, and such is set as the long diameter of the domain of the crystalline polyester and the maximum diameter of the domain of the wax.

The number average long diameter of the domains of the crystalline polyester domain is measured on the basis of the above STEM image. The maximum diameter of the domain of the wax is also measured.

Specifically, cross sections of 100 toner particles are observed. The long diameters of all the crystalline polyester domains present in the cross section of 100 toner particles are measured and the arithmetic average value thereof is calculated. The arithmetic average value thus obtained is taken as the number average long diameter of the domains of the crystalline polyester.

Similarly, the maximum diameters of all the wax domains present in the cross section of 100 toner particles are measured, and the arithmetic average value thereof is calculated. The arithmetic average value thus obtained is taken as the maximum diameter of the domain of the wax.

<Measurement of Number of Domains of Crystalline Polyester>

The number of domains of the crystalline polyester contained in a cross section of each of the toner particles is measured on the basis of the STEM image. This is done on the cross sections of 100 toner particles, and the arithmetic average value thereof is taken as the number of domains of the crystalline polyester.

<Calculation of Proportion of Area of Wax Domain to Cross Section Area of Toner>

The total area of the domain of the wax (referred to hereinbelow as "C") in the cross section of one toner particle and the cross section area of the toner particle (referred to hereinbelow as "D") are measured in the STEM image by using the image processing software "Image-Pro Plus" (manufactured by Media Cybernetics, Inc.).

When a plurality of domains of the wax is present in the cross section of one toner particle, the sum of the areas of the domains is taken as the total area of domains of the wax in the cross section of one toner particle.

Next, the proportion of the total area of the domain of the wax in the cross section of one toner particle is calculated by the following formula.

The proportion of the total area of the domain of the wax in the cross section of one toner particle={"C"/"D"}×100 (% by area).

This is done with respect to the cross sections of 100 toner particles, and the arithmetic average value thereof is taken as the proportion of the area of the domains of the wax.

<Identification of Terminal Structure of Crystalline Polyester>

A total of 2 mg of the resin sample is accurately weighed, and 2 mL of chloroform is added to cause dissolution and prepare a sample solution. The crystalline polyester is used as the resin sample, but it is also possible to substitute the toner as a sample.

Next, 20 mg of 2,5-dihydroxybenzoic acid (DHBA) is accurately weighed, and 1 mL of chloroform is added to cause dissolution and to prepare a matrix solution. Further, 3 mg of Na trifluoroacetate (NaTFA) is accurately weighed, then 1 mL of acetone is added to cause dissolution and to prepare an ionization assistant solution.

A total of 25 μL of the sample solution, 50 μL of the matrix solution, and 5 μL of the ionization assistant solution, which have thus been prepared, are mixed, dropped on a sample plate for MALDI analysis, and dried to obtain a measurement sample. A mass spectrum is obtained using MALDI-TOFMS (Reflex III manufactured by Bruker Daltonics Inc.) as an analytical device. In the obtained mass spectrum, attribution of each peak in the oligomer region (m/Z is not more than 2000) is performed, and it is checked whether or not there is a peak corresponding to a structure in which a monocarboxylic acid is bonded to the molecular chain end.

<Measurement of Glass Transition Temperature (Tg) of Resin and Toner>

The glass transition temperature (Tg) of the amorphous resin and the toner is measured according to ASTM D 3418-82 using a differential scanning calorimeter "Q1000" (manufactured by TA Instruments, Inc).

The melting points of indium and zinc are used for temperature correction of the detection unit of the apparatus, and heat of melting of indium is used for correction of the calorific value.

Specifically, 3.0 mg of the sample is accurately weighed and placed in an aluminum pan, an empty aluminum pan is used as a reference, and the measurement is performed in the measurement temperature range from 30° C. to 200° C. at a temperature rise rate of 10° C./min under normal temperature and humidity.

In this temperature rise process, a specific heat change is obtained in the temperature range of 40° C. to 100° C. The intersection of the differential thermal curve and the line at the midpoint of a baseline extending from before to after the specific heat change has appeared is taken as the glass transition temperature (Tg).

<Measurement of Tetrahydrofuran (THF) Insoluble Content of Toner>

A total of 1 g of the toner is accurately weighed and loaded in a cylindrical filter paper, and Soxhlet extraction is carried out for 20 h with 200 mL of THF. The cylindrical filter paper is then taken out and vacuum-dried for 20 h at 40° C. to measure the amount of residual material, and the amount of tetrahydrofuran (THF) insoluble matter of the resin component of the toner is calculated from the following formula.

The resin component of the toner, as referred to herein, is a component obtained by removing the magnetic bodies, the charge control agent, the wax component, the external additive, and the colorant from the toner. In measuring the THF insoluble content, the THF insoluble content based on the resin component is calculated with consideration for whether these included matters are soluble or insoluble in THF.

$$\text{THF insoluble content (\%)}=(W2-W3)/(W1-W3-W4)\times 100,$$

where W1: mass of the toner,

W2: residual mass,

W3: mass of a THF-insoluble component other than the resin component of the toner, W4: mass of a THF-soluble component other than the resin component of the toner.

<Measurement of Peak Molecular Weight (Mp) of Tetrahydrofuran (THF) Soluble Matter Such as Toner>

The molecular weight distribution of THF-soluble matter such as the toner is measured by gel permeation chromatography (GPC) in the following manner.

First, the toner or the like is dissolved in tetrahydrofuran (THF) over 24 h at room temperature. Then, the obtained solution is filtered through a solvent resistant membrane filter "Mae Shori Disk" (manufactured by Tosoh Corporation) having a pore diameter of 0.2 μm to obtain a sample solution. The sample solution is adjusted so that the concentration of the component soluble in THF is 0.8% by mass. Measurements are performed under the following conditions by using this sample solution.

Apparatus: "HLC8120 GPC" (Detector: RI) (manufactured by Tosoh Corporation)

Column: 7 sets of SHODEX KF-801, 802, 803, 804, 805, 806, 807 (manufactured by Showa Denko KK)

Eluent: tetrahydrofuran (THF)

Flow rate: 1.0 mL/min

Oven temperature: 40.0° C.

Sample injection amount: 0.10 mL

When the molecular weight of the sample is calculated, a molecular weight calibration curve is used which is prepared using a standard polystyrene resin (trade name "TSK Standard Polystyrene F-850, F-450, F-288, F-128, F-80, F-40, F-20, F-10, F-4, F-2, F-1, A-5000, A-2500, A-1000, A-500", manufactured by Tosoh Corporation).

<Method for Measuring Number Average Particle Diameter and Content of Magnetic Bodies>

The magnetic bodies to be observed are sufficiently dispersed in an epoxy resin, and then curing is performed for 2 days under an atmosphere at a temperature of 40° C. to obtain a cured product. The cured product thus obtained is sliced into flaky samples with a microtome, and a cross-sectional image is captured at a magnification of 40,000 times by using a scanning transmission electron microscope (STEM). The particle diameter of 100 magnetic bodies in the cross-sectional image is measured. Then, the number average particle diameter is calculated on the basis of the equivalent diameter of a circle equal to the projected area of the magnetic body.

Meanwhile, the content of the magnetic bodies is measured by the following procedure using a thermal analyzer (device name: TGA 7, manufactured by Perkin Elmer, Inc.).

The toner is heated from a normal temperature to 900° C. at a heating rate of 25° C./min under a nitrogen atmosphere. Mass reduction (%) between 100° C. and 750° C. is taken as the resin amount, and the residual mass is approximated as the amount of the magnetic bodies.

<Identification of Magnetic Bodies and Measurement of Presence Proportion (10% Ratio) of Magnetic Bodies>

Identification of the magnetic bodies can be performed according to the following procedure on the basis of the STEM image.

The STEM image (bright field image) is binarized by setting the threshold of brightness (gradation 255) to 60 and using image processing software "Image—Pro Plus" (manufactured by Media Cybernetics, Inc.).

Next, the outline and the center point of the cross section of the toner particle are found in the STEM image. A line is drawn from the obtained center point to a point on the outline of the cross section of the toner particle. A position at 10% of the distance between the outline and the center point of the cross section from the outline is specified on the line. The center of gravity of the cross section of the toner particle is taken as the center point of the cross section of the toner particle.

Figure 3:
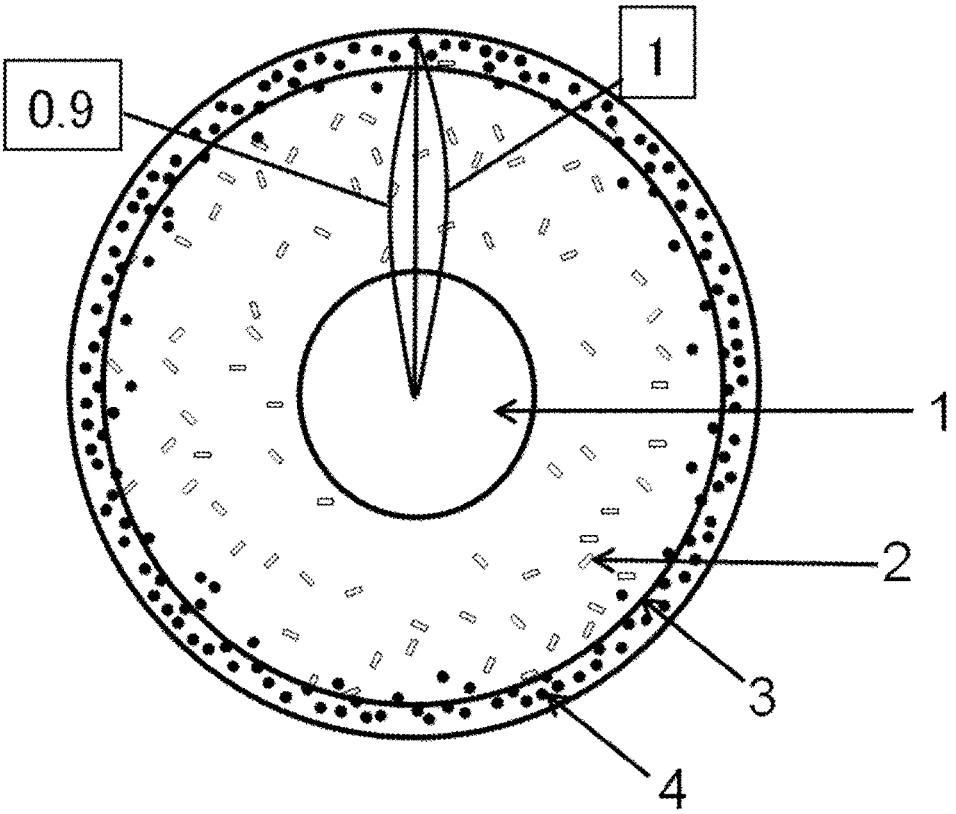
FIG. 3 is an example of a schematic view showing the presence state of domains of magnetic bodies and crystalline polyester.

Then, this operation is performed for one circumference with respect to the outline of the cross section of the toner particle, and a boundary line at 10% of the distance between the outline and the center point of the cross section from the outline of the cross section of the toner particle is clearly indicated (FIG. 3).

The sum (referred to hereinbelow as "A") of the areas (pixel×pixel) of all the magnetic bodies in the cross section of one toner particle, and the sum (referred to hereinbelow as "B") of the areas (pixel×pixel) of the magnetic bodies present in the region within 10% of the distance between the outline and the center point of the cross section from the outline of the cross section of the toner particle in the cross section of one toner particle are measured on the basis of the STEM image in which the boundary line at 10% are measured.

The magnetic bodies present on the 10% boundary line are measured as the "B".

Next, a 10% ratio of the magnetic bodies in the cross section of one toner particle is calculated by the following formula.

$$\text{10\% ratio of magnetic bodies in the cross section of one toner particle} = \{\text{"}B\text{"}/\text{"}A\text{"}\} \times 100(\%).$$

As described above, in the present invention, it is preferable that the proportion of the toner particles in which the 10% ratio of the magnetic bodies is at least 65% by area be at least 70% by number.

In a specific method for calculating the "% by number", a field of view where cross sections of 100 toner particles can be observed is selected as one field of view, and a 10% ratio is calculated for each of the 100 toner particles. Then, the number "C" of the toner having a 10% ratio of at least 65% by area is counted, and the value "C" is taken as the "% by number".

<Measurement of Crystallization Temperature Derived from Crystalline Substance in Toner>

Measurement of the crystallization temperature of the crystalline substance as an index for determining the annealing temperature suitable for annealing treatment will be described below.

First, since crystallization peaks can be obtained in the crystalline polyester or wax alone, the description will be based on this method.

The crystallization temperature and exothermic curve of the crystalline polyester or wax are measured using a differential scanning calorimeter "Q1000" (manufactured by TA Instruments, Inc.).

The melting points of indium and zinc are used for temperature correction of the detection unit of the apparatus, and heat of melting of indium is used for correction of the calorific value.

Specifically, 1.00 mg of the sample is accurately weighed and placed in an aluminum pan, an empty aluminum pan is used as a reference, and the measurement is performed under the following conditions.

Measurement mode: Standard.

Temperature increase rate 10° C./min. The temperature is raised from 20° C. to 100° C.

Temperature decrease rate 0.5° C./min. The temperature is decreased from 100° C. to 20° C.

A graph of Temperature—Heat Flow is prepared based on the obtained results, and an exothermic curve of the crystalline polyester or wax is obtained from the results obtained when the temperature was decreased. In this exothermic curve, the peak temperature of the maximum exothermic peak is taken as the crystallization temperature.

In order to obtain the crystallization temperature of the crystalline polyester or wax from the toner, an operation of insulation from the toner may be performed as described above and the units obtained may be analyzed by the abovementioned method.

EXAMPLES

The present invention will be described hereinbelow more specifically with reference to Production Examples and Examples, but the present invention is not intended to be limited thereto. "Parts" and "%" described in the Examples and Comparative Examples are all on a mass basis unless specified otherwise.

<Production of Crystalline Polyester 1>

A total of 100.0 parts of sebacic acid as a carboxylic acid monomer 1, 1.6 parts of stearic acid as a carboxylic acid monomer 2, and 89.3 parts of 1,9-nonanediol as an alcohol monomer were placed in a reaction vessel equipped with a nitrogen introducing tube, a dehydration tube, a stirrer, and a thermocouple.

A reaction was conducted for 8 h under a nitrogen atmosphere while distilling off water under atmospheric pressure by heating to 140° C. under stirring. Next, 0.57 part of tin dioctylate was added, and the reaction was performed while raising the temperature to 200° C. at a rate of 10° C./h. The reaction was further performed for 2 h after reaching 200° C. The interior of the reaction vessel was then depressurized to not more than 5 kPa, and the reaction was performed at 200° C. while observing the molecular weight to obtain a crystalline polyester 1. Physical properties of the obtained crystalline polyester 1 are shown in Table 1.

<Production of Crystalline Polyesters 2 to 9>

Crystalline polyesters 2 to 9 were obtained in the same manner except that the alcohol monomer and the carboxylic acid monomers 1 and 2 were changed as shown in Table 1 and the reaction time and reaction temperature were adjusted so as to obtain the desired physical properties in the production of the crystalline polyester 1. Physical properties of the obtained crystalline polyesters are shown in Table 1.

TABLE 1

| Crystalline polyester No. | Alcohol monomer | Carboxylic acid monomer 1 | Carboxylic acid monomer 2 | Weight average molecular weight (Mw) | Melting point (° C.) | Acid value (mg KOH/g) | Hydroxyl value (mg KOH/g) |
|---|---|---|---|---|---|---|---|
| 1 | 1,9-Nonanediol | Decanedioic acid (sebacic acid) | Stearic acid | 38000 | 70.0 | 2.0 | 5.5 |
| 2 | 1,10-Decanediol | Decanedioic acid (sebacic acid) | lauric acid | 38000 | 72.0 | 2.2 | 4.9 |
| 3 | 1,6-Hexanediol | 1,10-Decanedicarboxylic acid (dodecanedioic acid) | Stearic acid | 32000 | 73.0 | 2.5 | 5.2 |
| 4 | 1,6-Hexanediol | Hexanedioic acid (adipic acid) | Stearic acid | 45000 | 58.0 | 1.5 | 3.5 |
| 5 | 1,12-Dodecanediol | Decanedioic acid (sebacic acid) | Behenic acid | 25000 | 79.0 | 2.1 | 5.3 |
| 6 | 1,4-Butanediol | Decanedioic acid (sebacic acid) | Lignoceric acid | 16000 | 65.0 | 4.5 | 7.2 |

TABLE 1-continued

| Crystalline polyester No. | Alcohol monomer | Carboxylic acid monomer 1 | Carboxylic acid monomer 2 | Weight average molecular weight (Mw) | Melting point (° C.) | Acid value (mg KOH/g) | Hydroxyl value (mg KOH/g) |
|---|---|---|---|---|---|---|---|
| 7 | 1,6-Hexanediol | Octadecanedicarboxylic acid | Lignoceric acid | 19200 | 90.0 | 4.0 | 6.8 |
| 8 | 1,18-Octadecanediol | Decanedioic acid (sebacic acid) | — | 16000 | 102.0 | 5.0 | 38.3 |
| 9 | 1,10-Decanediol | Decanedioic acid (sebacic acid) | Stearic acid | 55000 | 76.0 | 1.1 | 3.8 |

<Production Example of Magnetic Iron Oxide>

A total of 55 L of a 4.0 mol/L aqueous solution of sodium hydroxide was mixed and stirred into 50 L of an aqueous solution of ferrous sulfate containing $Fe^{2+}$ at 2.0 mol/L to obtain an aqueous solution of a ferrous salt including a ferrous hydroxide colloid. This aqueous solution was kept at 85° C. and oxidation reaction was carried out while blowing air at 20 L/min to obtain a slurry including core particles.

After filtering and washing the obtained slurry with a filter press, the core particles were again dispersed in water to obtain a re-dispersion liquid.

Sodium silicate was added to this re-dispersion liquid at 0.20 part, in terms of silicon, per 100 parts of the core particles, the pH of the re-dispersion liquid was adjusted to 6.0, and stirring was performed to obtain magnetic iron oxide particles having a silicon-rich surface.

The obtained slurry was filtered and washed with a filter press and then re-dispersed in ion exchanged water to obtain a re-dispersion liquid.

A total of 500 g (10% by mass on the basis of magnetic iron oxide) of ion exchange resin SK110 (manufactured by Mitsubishi Chemical Corporation) was added to this re-dispersion liquid (solid content 50 g/L) and stirred for 2 h to perform ion exchange. The ion exchange resin was then removed by filtration through a mesh, filtered and washed with a filter press, and dried and deagglomerated to obtain magnetic iron oxide having a number average particle diameter of primary particles of 0.23 μm.

<Production Example of Silane Compound 1>

A total of 30 parts of iso-butyltrimethoxysilane was dropwise added to 70 parts of ion-exchanged water under stirring. The obtained aqueous solution was kept at a pH of 5.5 and a temperature of 55° C. and stirred for 120 min at a peripheral speed of 0.46 m/s using a Disper blade to hydrolyze iso-butyltrimethoxysilane. The pH of the aqueous solution was then adjusted to 7.0, and the solution was cooled to 10° C. to stop the hydrolysis reaction and obtain an aqueous solution including a silane compound 1.

<Production Example of Silane Compound 2>

An aqueous solution including a silane compound 2 was prepared in the same manner as in the production example of the silane compound 1, except that iso-butyltrimethoxysilane was changed to n-hexyltrimethoxysilane and the pH at the time of hydrolysis was adjusted to 4.5.

<Production Example of Magnetic Bodies 1>

A total of 100 parts of magnetic iron oxide was placed in a high-speed mixer (LFS-2 type, manufactured by Fukae Powtec Co., Ltd.), and an aqueous solution including 8.0 parts of the silane compound 1 was dropwise added over 2 min while stirring at 2000 rpm. Mixing and stirring were then performed for 5 min.

Next, in order to improve the fixing ability of the silane compound, the silane compound was dried for 1 h at 40° C. to reduce moisture and then dried for 3 h at 110° C. to advance the condensation reaction of the silane compound.

Magnetic bodies 1 were thereafter obtained through deagglomeration and sieving with a sieve having openings of 100 μm.

<Production Example of Magnetic Bodies 2>

Magnetic bodies 2 were obtained in the same manner as in the production example of the magnetic bodies 1, except that an aqueous solution including the silane compound 2 was used instead of the aqueous solution including the silane compound 1.

<Colorant 1 for Nonmagnetic Toner>

Commercially available carbon black 1 was used as a colorant for a nonmagnetic toner. The carbon black 1 (denoted as CB 1 in the table) had the following properties: the number average particle diameter of primary particles was 31 nm, the DPB oil absorption amount was 40 mL/100 g, and the work function was 4.71 eV.

Waxes used in this Example and Comparative Example are shown in Table 2 below.

TABLE 2

| Wax No. | Types | Melting points (° C.) |
|---|---|---|
| 1 | Behenyl behenate | 72.0 |
| 2 | Distearyl sebacate | 66.0 |
| 3 | Debehenyl sebacate | 74.0 |
| 4 | Dipentaerythritol hexastearate | 78.0 |
| 5 | Dipentaerythritol hexabehenate | 82.0 |
| 6 | Pentaerythritol tetrabehenate | 85.0 |
| 7 | Paraffin wax 1 | 75.0 |
| 8 | Paraffin wax 2 | 86.0 |

<Production Example of Toner Base Particle 1>

A total of 450 parts of an aqueous solution (0.1 mol/L) of $Na_3PO_4$ was added to 720 parts of ion exchanged water, followed by heating to 60° C. Then, an aqueous medium was prepared by adding 67.7 parts by mass of an aqueous solution of $CaCl_2$ (1.0 mol/L) and stirring at 1200 r/min using CLEARMIX (manufactured by M Technique Co., Ltd.).

(Magnetic Body Dispersion Step)

Styrene 76.0 parts

N-butyl acrylate 24.0 parts 1, 6-Hexanediol diacrylate 0.65 parts

Iron complex of monoazo dye (T-77: manufactured by Hodogaya Chemical Co., Ltd.) 1.5 part

| | |
|---|---|
| Magnetic bodies 1 | 90.0 parts |
| Amorphous saturated polyester resin | 5.0 parts |

(Saturated polyester resin obtained by polycondensation reaction of ethylene oxide (2 mol) adduct of bisphenol A and terephthalic acid; number average molecular weight (Mn)=5000, acid value=6 mg KOH/g, glass transition temperature (Tg)=68° C.)

The above formulation was treated for 2 h at a peripheral speed of a rotor of 35 m/s by using CAVITRON (manufactured by Eurotec Corporation), and uniformly dispersed and mixed to obtain a magnetic body-containing polymerizable monomer.

(Polymerizable Monomer Composition Preparation Step)

The magnetic body-containing polymerizable monomer obtained in the magnetic body dispersion step was heated to 63° C., the following raw materials were added, and treatment was performed for 1 h at the peripheral speed of the rotor of 35 m/s using CAVITRON (manufactured by Eurotec Corporation) to obtain a polymerizable monomer composition.

| | |
|---|---|
| Crystalline polyester 1 | 7.0 parts |
| Wax 3 | 10.0 parts |
| Wax 7 | 5.0 parts |

(Granulation Step and Polymerization Step)

The polymerizable monomer composition was loaded into the aqueous medium and stirred for 7 min at 1200 r/min and 60° C. under a nitrogen atmosphere by using CLEARMIX (manufactured by M Technique Co., Ltd.), and 9.0 parts of tert-butyl peroxypivalate was added as a polymerization initiator. Granulation was then performed by stirring for 13 min. Next, the polymerization reaction was carried out for 4 h at 70° C. while stirring with a paddle stirring blade. After completion of the reaction, the dispersion including the resin particles was heated to 100° C. and held for 2 h.

(Cooling Step)

Then, as a cooling step, water at normal temperature was added to the dispersion, the dispersion was cooled from 100° C. to 50° C. at a rate of 150° C./min, then kept for 100 min at 50° C., and allowed to cool to normal temperature (a temperature of not more than 30° C. is considered hereinbelow as normal temperature). The crystallization temperature of the crystalline polyester 1 was 53° C.

Hydrochloric acid was then added to the dispersion, and the dispersion was thoroughly washed to dissolve the dispersing agent. Toner particles 1 were then obtained by filtration and drying. The glass transition temperature (Tg) of the toner particles was 56° C. Tables 3-1 and 3-2 show the formulation and production method for the toner base particles 1.

<Production Example of Toner 1>

A total of 100 parts of toner base particles 1 and 0.8 part of hydrophobic silica fine particles having a BET specific surface area of 300 $m^2/g$ and a number average particle diameter of primary particles of 8 nm were mixed with a Henschel mixer (manufactured by Mitsui Miike Chemical Engineering Machinery, Co., Ltd.) to obtain a toner 1. Physical properties of the toner 1 are shown in Table 4.

<Production Examples of Toner Base Particles 2 to 11 and Comparative Toner Base Particles 1 to 7>

Toner base particles 2 to 11 and comparative toner base particles 1 to 7 were obtained in the same manner as in the production example of the toner base particles 1, except that the formulation and production method of the toner base particles in the production example of the toner base particles 1 were changed as shown in Tables 3-1 and 3-2.

<Production Example of Toner Base Particles 12 to 14>

Toner base particles 12 to 14 were obtained in the same manner as in the production example of the toner base particles 1, except that carbon black 1 was used instead of the magnetic body 1 and the formulation and production method for the toner base particles in the production example of the toner base particles 1 were changed as shown in Tables 3-1 and 3-2.

In each of the toner base particles 1 to 14 and the comparative toner base particles 1 to 7, the glass transition temperature was in the range of 54° C. to 57° C. and the weight average particle diameter (D4) was 6.5 μm to 9.0 μm.

The "cooling rate" in Tables 3-1 and 3-2 will be described hereinbelow in detail.

The condition of "150° C./min" (described as "1" in Tables 3-1 and 3-2) indicates that in the cooling step, the dispersion is cooled at a rate of 150° C./min from 100° C. to near the crystallization temperature of the crystalline polyester, then held for 100 min at the same temperature, and allowed to cool to normal temperature, as described in the production example of the toner particle 1.

The stop temperature and holding temperature of the cooling step were determined by checking the crystallization temperature of the crystalline polyester in advance.

Similarly, the condition of "100° C./min" (denoted by "2" in Tables 3-1 and 3-2) indicates that in the cooling step, the dispersion is cooled at a rate of 100° C./min from 100° C. to near the crystallization temperature of the crystalline polyester, and then held and allowed to cool in the same manner as described hereinabove. Similarly, the condition of "50° C./min" (described as "3" in Tables 3-1 and 3-2) indicates that in the cooling step, the dispersion is cooled at a rate of 50° C./min from 100° C. to near the crystallization temperature of the crystalline polyester, and then held and allowed to cool in the same manner as described hereinabove.

The condition of "Annealing" (denoted by "4" in Tables 3-1 and 3-2) indicates that in the cooling step, the temperature is lowered at a rate of 0.5° C./min from the temperature of 100° C. to near the crystallization temperature of the crystalline polyester, followed by holding for 3 h at this temperature (crystallization temperature ±3° C.), and the system is then allowed to cool to normal temperature.

The condition of "Short annealing" (denoted by "5" in Tables 3-1 and 3-2) indicates that in the cooling step, the temperature is lowered at a rate of 0.5° C./min from the temperature of 100° C. to near the crystallization temperature of the crystalline polyester, followed by holding for 20 min at this temperature (crystallization temperature ±3° C.), and the system is then allowed to cool to normal temperature.

"Gradual cooling" (denoted by "6" in Tables 3-1 and 3-2) indicates that in the cooling step, cooling is performed at a rate of 0.5° C./min from 100° C. to normal temperature.

Meanwhile, regarding the "Stirring device" in Tables 3-1 and 3-2, the notion of "2" in Tables 3-1 and 3-2 means that CLEARMIX DISSOLVER (manufactured by M Technique Co., Ltd.) is used instead of the CAVITRON (manufactured by Eurotec Corporation) (denoted by "1" in Tables 3-1 and 3-2).

<Production Examples of Toners 2 to 14 and Comparative Toners 1 to 7>

Toners 2 to 14 and comparative toners 1 to 7 were obtained in the same manner as in the production example of toner 1, except that the toner base particles in the production example of toner 1 were changed to toner base particles 2 to 14 and comparative toner base particles 1 to 7. Physical properties of the obtained toners are shown in Table 4.

TABLE 3-1

| Toner particle No. | Crystalline polyester Type | Crystalline polyester Number of parts | Wax 1 Type | Wax 1 Number of parts | Wax 2 Type | Wax 2 Number of parts | Colorant Type | Colorant Number of parts | Crosslinking agent Number of parts | Amorphous polyester Number of parts | Cooling rate | Stirring device |
|---|---|---|---|---|---|---|---|---|---|---|---|---|
| 1 | 1 | 7.0 | 3 | 10.0 | 7 | 5.0 | Magnetic bodies 1 | 90.0 | 0.65 | 5.0 | 1 | 1 |
| 2 | 1 | 12.0 | 3 | 10.0 | 7 | 10.0 | Magnetic bodies 1 | 90.0 | 0.50 | 5.0 | 1 | 1 |
| 3 | 3 | 5.0 | 3 | 5.0 | 7 | 5.0 | Magnetic bodies 1 | 70.0 | 0.50 | 5.0 | 2 | 1 |
| 4 | 2 | 15.0 | 2 | 10.0 | 7 | 5.0 | Magnetic bodies 1 | 90.0 | 0.75 | 5.0 | 1 | 1 |
| 5 | 5 | 5.0 | 6 | 5.0 | 7 | 3.0 | Magnetic bodies 1 | 70.0 | 0.80 | 5.0 | 2 | 1 |
| 6 | 6 | 5.0 | 1 | 5.0 | 8 | 5.0 | Magnetic bodies 1 | 90.0 | 0.65 | 5.0 | 2 | 1 |
| 7 | 9 | 5.0 | 5 | 5.0 | 7 | 5.0 | Magnetic bodies 1 | 90.0 | 0.65 | 5.0 | 2 | 2 |
| 8 | 9 | 5.0 | 5 | 4.0 | 7 | 2.0 | Magnetic bodies 2 | 90.0 | 0.75 | 5.0 | 2 | 2 |
| 9 | 6 | 5.0 | — | — | 8 | 5.0 | Magnetic bodies 2 | 90.0 | 0.75 | 5.0 | 2 | 2 |
| 10 | 9 | 2.0 | 5 | 4.0 | 7 | 2.0 | Magnetic bodies 2 | 90.0 | 0.75 | 5.0 | 2 | 2 |
| 11 | 5 | 20.0 | 6 | 5.0 | 7 | 3.0 | Magnetic bodies 2 | 70.0 | 0.65 | 5.0 | 2 | 2 |
| 12 | 1 | 7.0 | 3 | 10.0 | 7 | 5.0 | CB1 | 5.5 | 0.60 | 5.0 | 1 | 1 |
| 13 | 1 | 7.0 | 3 | 10.0 | 7 | 5.0 | CB1 | 5.5 | 0.60 | 10.0 | 1 | 1 |
| 14 | 1 | 7.0 | 3 | 10.0 | 7 | 5.0 | CB1 | 5.5 | 0.60 | 20.0 | 1 | 1 |

TABLE 3-2

| Toner particle No. | Crystalline polyester Type | Crystalline polyester Number of parts | Wax 1 Type | Wax 1 Number of parts | Wax 2 Type | Wax 2 Number of parts | Colorant Type | Colorant Number of parts | Crosslinking agent Number of parts | Amorphous polyester Number of parts | Cooling rate | Stirring device |
|---|---|---|---|---|---|---|---|---|---|---|---|---|
| Comparative 1 | 4 | 3.0 | 3 | 10.0 | 7 | 5.0 | Magnetic bodies 2 | 90.0 | 0.65 | 5.0 | 1 | 2 |
| Comparative 2 | 7 | 15.0 | 3 | 10.0 | 7 | 10.0 | Magnetic bodies 2 | 90.0 | 0.65 | 5.0 | 4 | 2 |
| Comparative 3 | 8 | 15.0 | 3 | 10.0 | 7 | 10.0 | Magnetic bodies 2 | 90.0 | 0.65 | 5.0 | 1 | 2 |
| Comparative 4 | 6 | 10.0 | 4 | 5.0 | 8 | 5.0 | Magnetic bodies 2 | 90.0 | 0.65 | 5.0 | 6 | 2 |
| Comparative 5 | 1 | 7.0 | 3 | 10.0 | 7 | 5.0 | CB1 | 5.5 | 0.60 | 30.0 | 3 | 1 |
| Comparative 6 | 5 | 1.0 | 6 | 3.0 | 7 | 3.0 | Magnetic bodies 2 | 70.0 | 0.65 | 5.0 | 2 | 2 |
| Comparative 7 | 6 | 15.0 | 4 | 5.0 | 8 | 5.0 | Magnetic bodies 2 | 70.0 | 0.50 | 5.0 | 5 | 2 |

In Tables 3-1 and 3-2, the "Crosslinking agent" is 1,6-hexanediol diacrylate.

Further, the "Amorphous polyester" is an amorphous saturated polyester resin; saturated polyester resin obtained by a condensation polymerization reaction of ethylene oxide (2 mol) adduct of bisphenol A and terephthalic acid; number average molecular weight (Mn)=5000, acid value=6 mg KOH/g, and glass transition temperature (Tg)=68° C.

TABLE 4

| Toner base particle No. | W(t) (° C.) | P(t) (° C.) | G'(50) ($\times 10^8$ Pa) | G'(50)/G'(80) ($\times 10^2$) | G'(120) ($\times 10^4$ Pa) | G'(t)/G'(120) ($\times 10^2$) | A | W(t) − P(t) (° C.) | THF insoluble content (%) | Small domains Long diameter (nm) | Small domains Number | Large domains Maximum diameter (μm) | B | C |
|---|---|---|---|---|---|---|---|---|---|---|---|---|---|---|
| 1 | 74.0 | 70.0 | 5.4 | 6.5 | 2.2 | 4.6 | 0.47 | 4.0 | 28 | 110 | 200 | 2.5 | 25.0 | 82 |
| 2 | 74.0 | 70.0 | 5.6 | 9.5 | 1.5 | 5.2 | 0.60 | 4.0 | 13.5 | 70 | 280 | 3.8 | 48.0 | 84 |
| 3 | 74.0 | 73.0 | 4.4 | 3.2 | 2.2 | 6.4 | 0.50 | 1.0 | 13.8 | 300 | 20 | 1.5 | 15.0 | 78 |
| 4 | 75.0 | 72.0 | 6.2 | 9.8 | 4.2 | 2.2 | 1.00 | 3.0 | 44.5 | 80 | 300 | 2.7 | 30.0 | 82 |
| 5 | 75.0 | 79.0 | 4.4 | 3.1 | 6.5 | 1.4 | 0.63 | −4.0 | 48 | 350 | 38 | 1.4 | 15.0 | 76 |
| 6 | 72.0 | 65.0 | 5.0 | 3.3 | 3.2 | 6.5 | 0.50 | 7.0 | 25 | 490 | 12 | 1.5 | 14.0 | 79 |
| 7 | 75.0 | 76.0 | 4.7 | 3.8 | 3.0 | 4.9 | 0.50 | −1.0 | 28 | 330 | 25 | 1.8 | 17.0 | 68 |

TABLE 4-continued

| Toner base particle No. | W(t) (° C.) | P(t) (° C.) | G'(50) ($\times 10^8$ Pa) | G'(50)/G'(80) ($\times 10^2$) | G'(120) ($\times 10^4$ Pa) | G'(t)/G'(120) ($\times 10^2$) | A | W(t) − P(t) (° C.) | THF insoluble content (%) | Small domains Long diameter (nm) | Small domains Number | Large domains Maximum diameter (μm) | B | C |
|---|---|---|---|---|---|---|---|---|---|---|---|---|---|---|
| 8 | 75.0 | 76.0 | 4.5 | 3.5 | 5.5 | 3.1 | 0.83 | −1.0 | 44 | 310 | 14 | 1.0 | 10.0 | 63 |
| 9 | 86.0 | 65.0 | 4.6 | 3.2 | 2.9 | 6.7 | 1.00 | 21.0 | 16 | 250 | 5 | 0.9 | 8.0 | 63 |
| 10 | 75.0 | 76.0 | 4.5 | 3.1 | 5.7 | 3.5 | 0.33 | −1.0 | 42 | 450 | 8 | 1.1 | 11.0 | 62 |
| 11 | 75.0 | 79.0 | 4.2 | 4.5 | 4.5 | 3.2 | 2.50 | −4.0 | 25 | 330 | 50 | 1.5 | 16.0 | 61 |
| 12 | 74.0 | 70.0 | 4.6 | 6.2 | 1.7 | 5.2 | 0.47 | 4.0 | 20 | 90 | 250 | 2.4 | 24.0 | — |
| 13 | 74.0 | 70.0 | 4.4 | 5.5 | 1.6 | 5.4 | 0.47 | 4.0 | 19 | 100 | 230 | 2.5 | 26.0 | — |
| 14 | 74.0 | 70.0 | 4.2 | 4.8 | 1.5 | 5.8 | 0.47 | 4.0 | 17 | 120 | 220 | 2.3 | 24.0 | — |
| Comparative 1 | 74.0 | 58.0 | 4.3 | 3.8 | 5.2 | 3.3 | 0.20 | 16.0 | 26 | 60 | 220 | 2.5 | 35.0 | 64 |
| Comparative 2 | 75.0 | 90.0 | 5.0 | 3.2 | 6.5 | 1.6 | 0.75 | −15.0 | 25 | 380 | 25 | 3.6 | 47.0 | 64 |
| Comparative 3 | 75.0 | 102.0 | 5.1 | 2.5 | 6.8 | 1.8 | 0.75 | −27.0 | 27 | 420 | 30 | 3.7 | 46.0 | 64 |
| Comparative 4 | 78.0 | 65.0 | 3.1 | 4.8 | 3.0 | 2.8 | 1.00 | 13.0 | 28 | 0 | 0 | 1.8 | 17.0 | 63 |
| Comparative 5 | 74.0 | 70.0 | 3.5 | 4.1 | 1.2 | 6.7 | 0.47 | 4.0 | 20 | 125 | 225 | 2.4 | 25.0 | — |
| Comparative 6 | 75.0 | 79.0 | 4.8 | 2.7 | 6.5 | 2.6 | 0.17 | −4.0 | 26 | 300 | 5 | 1.2 | 12.0 | 59 |
| Comparative 7 | 78.0 | 65.0 | 4.3 | 3.8 | 1.5 | 7.7 | 1.50 | 13.0 | 14 | 0 | 0 | 1.8 | 18.0 | 62 |

In Table 4, "A" represents "the ratio of the content of the crystalline polyester to the content of the wax".

The "Long diameter" of the small domain represents "the number average long diameter of the domains of the crystalline polyester" in the cross section of the toner particle observed under a scanning transmission electron microscope, and the "Maximum diameter" of the large domain represents the "maximum diameter of the domain of the wax" in the cross section of each of the toner particles observed under a scanning transmission electron microscope.

"B" represents the proportion (% by area) of the area of the domain of the wax to the area of the cross section of each of the toner particles.

"C" represents the proportion (% by number) of toner particles having a 10% ratio of at least 65% by area.

Example 1

(Evaluation 1: Fogging after Allowing the Toner to Stand Under a High-Temperature Severe Environment)

LBP-6300 (manufactured by Canon Inc.) was used as an image forming apparatus.

A modified cartridge obtained by replacing a developing sleeve with a diameter of 14 mm with a developing sleeve with a diameter of 10 mm was used as the cartridge.

When a cartridge equipped with a small-diameter developing sleeve is used, the nip between the developing sleeve and the developing blade is narrowed, and the charge providing performance of the toner is degraded. Therefore, fogging can be rigorously evaluated.

After outputting a horizontal line chart with a print percentage of 4% under a low-temperature and low-humidity environment (15° C./10% RH) by using the modified cartridge filled with the toner 1, two solid white images were printed and fogging of the second print was measured by the following method. The fogging value at this time was taken as fogging before allowing the toner to stand under a severe environment.

Next, the modified cartridge filled with the toner 1 was allowed to stand for 12 h under a high-temperature environment (50° C./55% RH) to impart a history of severe environment. After outputting a horizontal line chart with a print percentage of 4% under a low-temperature and low-humidity environment (15° C./10% RH) by using the modified cartridge filled with the toner 1, two solid white images were printed and fogging of the second print was measured by the following method. The fogging value at this time was taken as fogging after allowing the toner to stand under a high-temperature severe environment.

First, a method for measuring the fogging is described. The reflectance of the second solid white image was measured using REFLECTMETER MODEL TC-6DS manufactured by Tokyo Denshoku Co., Ltd. Meanwhile, the reflectance of the transfer paper (standard paper) before forming the solid white image was measured in the same manner. For the filter, a green filter was used. Further, fogging (reflectance, %) was calculated using the following formula. Fogging (reflectance) (%)=Reflectance (%) of Standard Paper−Reflectance (%) of Second Solid White Image The determination criteria are presented below.

A: less than 1.0%

B: at least 1.0% and less than 1.5%

C: at least 1.5% and less than 2.5%

D: at least 2.5%

(Evaluation 2: Trailing End Offset)

The modified apparatus used in Evaluation 1 was used as the image forming apparatus, and the setting of the fixing device was changed so that the temperature control of the fixing device was lowered by 10° C. Further, the modified cartridge used in Evaluation 1 was used for the cartridge.

The fixing device was removed between evaluations under a high-temperature and high-humidity environment (32.5° C./80% RH), and the following evaluations were performed after the fixing device was sufficiently cooled with a fan or the like.

By sufficiently cooling the fixing device after the evaluation to decrease the temperature of the fixing nip portion which has increased after the image output, it is possible to evaluate the fixing performance of the toner rigorously and with satisfactory reproducibility.

When evaluating the trailing end offset, Oce Red Label paper of an A4 size (basis weight 80 g/m$^2$; manufactured by Canon Inc.) which was allowed to stand for at least 48 h under the high-temperature and high-humidity environment was used as a recording material.

By using the paper that is relatively heavy and has a large surface roughness and that was allowed to stand under the high-temperature and high-humidity environment (paper subjected to severe environment), it is possible to evaluate rigorously the trailing end offset.

After the fixing device was sufficiently cooled, a solid black image was outputted by using the toner 1 on the paper subjected to severe environment.

At this time, the amount of applied toner on the paper was adjusted to 9 g/m$^2$.

In the evaluation result of the toner 1, a satisfactory solid black image without small white dots was obtained.

As criteria for determining the trailing end offset, a level of small white dots on a solid black image was visually evaluated with respect to the solid black image outputted in the above procedure. The determination criteria are presented below.

A: there are no small white dots (very good).

B: when looking closely, some small white dots can be seen (good).

C: small white dots can be seen, but are not conspicuous (ordinary).

D: small white dots are conspicuous (poor).

(Evaluation 3: Density Unevenness in the Case of Outputting s Halftone Image)

The modified apparatus used in Evaluation 1 was used as the image forming apparatus, and the setting of the fixing device was changed so that the temperature control of the fixing device was increased by 10° C. Further, the modified cartridge used in Evaluation 1 was used for the cartridge.

As a result of increasing the temperature control of the fixing device by 10° C., melting and spreading of protrusions on the paper are intensified. Therefore, density unevenness can be evaluated more rigorously.

When evaluating the density unevenness of a halftone image, Oce Red Label paper of an A4 size (basis weight 80 g/m$^2$; manufactured by Canon Inc.) was used as the recording material.

By using the paper with a relatively large surface roughness, it is possible to evaluate rigorously the density unevenness of the halftone image.

Here, the density unevenness of the halftone image (halftone) when the amount of applied toner was 9 g/m$^2$ in the solid black image was evaluated according to the following criteria.

A: density unevenness is completely inconspicuous (very good).

B: when looking closely, density unevenness is somewhat observed (good).

C: there is density unevenness, but it is not conspicuous (ordinary).

D: density unevenness is conspicuous (poor).

Examples 2 to 14 and Comparative Examples 1 to 7

Various evaluations were performed in the same manner as in Example 1, except that the toner 1 in Example 1 was changed to toners 2 to 14 and comparative toners 1 to 7. In Examples 12 to 14 and Comparative Example 5, the evaluation was performed after modifying the image forming apparatus so as to enable the output with a nonmagnetic toner. These evaluation results are shown in Table 5.

TABLE 5

| | Toner No. | Evaluation 1 | Evaluation 2 | Evaluation 3 |
|---|---|---|---|---|
| Example 1 | 1 | A (0.5) | A | A |
| Example 2 | 2 | A (0.6) | A | A |
| Example 3 | 3 | B (1.4) | A | B |
| Example 4 | 4 | A (0.4) | A | A |
| Example 5 | 5 | B (1.4) | B | A |
| Example 6 | 6 | A (0.7) | B | B |
| Example 7 | 7 | A (0.8) | B | A |
| Example 8 | 8 | B (1.3) | B | A |

TABLE 5-continued

| | Toner No. | Evaluation 1 | Evaluation 2 | Evaluation 3 |
|---|---|---|---|---|
| Example 9 | 9 | A (0.9) | C | C |
| Example 10 | 10 | B (1.3) | C | A |
| Example 11 | 11 | C (2.1) | A | A |
| Example 12 | 12 | A (0.8) | A | A |
| Example 13 | 13 | B (1.4) | A | A |
| Example 14 | 14 | C (2.3) | A | B |
| Comparative Example 1 | Comparative 1 | D (2.7) | B | A |
| Comparative Example 2 | Comparative 2 | A (0.7) | D | A |
| Comparative Example 3 | Comparative 3 | A (0.8) | D | A |
| Comparative Example 4 | Comparative 4 | D (2.8) | C | A |
| Comparative Example 5 | Comparative 5 | D (2.9) | B | C |
| Comparative Example 6 | Comparative 6 | A (0.9) | D | A |
| Comparative Example 7 | Comparative 7 | B (1.4) | C | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-101238, filed May 20, 2016, which is hereby incorporated by reference herein in its entirety.

What is claimed is:

1. A toner comprising toner particles, each of which contains a binder resin, a colorant, a wax and a crystalline polyester, wherein a melting point P(t) of the crystalline polyester is at least 65.0° C. and not more than 80.0° C.; and regarding a storage elastic modulus G' obtained in dynamic viscoelasticity measurement of the toner, where G' at 50° C. is denoted by G'(50), G' at 80° C. is denoted by G'(80), G' at 120° C. is denoted by G'(120), and G' at the melting point P(t) of the crystalline polyester is denoted by G'(t), all of the following formulas (1) to (3) are satisfied:

$$4.2\times10^8\ \text{Pa}\leq G'(50) \quad (1)$$

$$3.0\times10^2\leq G'(50)/G'(80) \quad (2)$$

$$G'(t)/G'(120)\leq 7.0\times10^2 \quad (3).$$

2. The toner according to claim 1, wherein a content of the crystalline polyester is at least 3.0 parts by mass and not more than 15.0 parts by mass with respect to 100 parts by mass of the binder resin; and the ratio of the content of the crystalline polyester to the content of the wax is at least 0.30 and not more than 1.00 on a mass basis.

3. The toner according to claim 1, wherein where a melting point of the wax is denoted by W(t) and the melting point of the crystalline polyester is denoted by P(t), the W(t) and the P(t) satisfy the following formula (4):

$$-10.0°\ \text{C.}\leq\{W(T)-P(t)\}\leq 20.0°\ \text{C.} \quad (4).$$

4. The toner according to claim 1, wherein the binder resin includes a styrene acrylic resin; and the content of the styrene acrylic resin in the binder resin is at least 50% by mass and not more than 100% by mass.

5. The toner according to claim 1, wherein the wax includes an ester wax.

6. The toner according to claim 1, wherein in cross-sectional observations of each of the toner particles under a scanning transmission electron microscope, domains of the crystalline polyester are present in a cross section of each of the toner particles;

a number-average long diameter of the domains of the crystalline polyester is at least 5 nm and not more than 500 nm; and the number of domains of the crystalline polyester per cross section of each of the toner particles is at least 8 and not more than 500.

7. The toner according to claim 1, wherein in cross-sectional observations of each of the toner particles under a scanning transmission electron microscope, a domain of the wax is present in a cross section of each of the toner particles;

a maximum diameter of the domain of the wax is at least 1.0 μm and not more than 5.0 μm; and a proportion of an area of the domain of the wax to an area of the cross section of each of the toner particles is at least 10.0% by area and not more than 60.0% by area.

8. The toner according to claim 1, wherein the crystalline polyester is a polyester having a structure derived from an acid monomer selected from lauric acid, stearic acid, and behenic acid at a molecular chain end.

* * * * *